US010143259B2

(12) United States Patent
Liao et al.

(10) Patent No.: US 10,143,259 B2
(45) Date of Patent: Dec. 4, 2018

(54) HELMET WITH TRANSFORMABLE JAW PROTECTING STRUCTURE BASED ON GEAR CONSTRAINT

(71) Applicant: JIANGMEN PENGCHENG HELMETS LTD., Heshan (CN)

(72) Inventors: Haotian Liao, Heshan (CN); Youjun Feng, Heshan (CN)

(73) Assignee: JIANGMEN PENGCHENG HELMETS LTD., Heshan (CN)

( * ) Notice: Subject to any disclaimer, the term of this patent is extended or adjusted under 35 U.S.C. 154(b) by 209 days.

(21) Appl. No.: 15/124,608

(22) PCT Filed: Jul. 6, 2016

(86) PCT No.: PCT/CN2016/088778
§ 371 (c)(1),
(2) Date: Sep. 8, 2016

(87) PCT Pub. No.: WO2017/210945
PCT Pub. Date: Dec. 14, 2017

(65) Prior Publication Data

US 2018/0213877 A1 Aug. 2, 2018

(30) Foreign Application Priority Data

Jun. 8, 2016 (CN) ..... 2016 1 0408172

(51) Int. Cl.
*A42B 3/04* (2006.01)
*A42B 3/32* (2006.01)
(Continued)

(52) U.S. Cl.
CPC ..... *A42B 3/326* (2013.01); *A42B 3/205* (2013.01); *A42B 3/223* (2013.01); *A42B 3/225* (2013.01)

(58) Field of Classification Search
CPC ..... A42B 3/326; A42B 3/064; A42B 3/222
See application file for complete search history.

(56) References Cited

U.S. PATENT DOCUMENTS 6,892,400 B1 5/2005 Choi et al.
9,032,557 B2 5/2015 Bryant et al.
(Continued)

FOREIGN PATENT DOCUMENTS

AU 2016225881 A1 * 1/2018 ..... A42B 3/326
CN 1636475 A 7/2005
(Continued)

OTHER PUBLICATIONS

International Search Report for Application No. PCT/CN2016/088778 dated Feb. 16, 2017.

*Primary Examiner* — Bobby Muromoto, Jr.
(74) *Attorney, Agent, or Firm* — The Dobrusin Law Firm, P.C.

(57) ABSTRACT

The invention belongs to the technical field of helmets and relates to a helmet with a transformable jaw protecting structure, wherein a jaw protector is reliably transformed between a full-face helmet position and a half-face helmet position in a gear constraint structure and mode, and the uniqueness and reversibility of a kinematical and geometrical locus of the jaw protector can be kept everywhere during a round trip. The helmet according to the invention has the greatest advantages that: the integrity of a whole structure of the mount and the jaw protector can be kept while implementing a transformable jaw protecting structure of the helmet in the meanwhile, thus ensuring that these core members have higher intensity and rigidity, and effectively enhancing the use safety of the helmet; in addition, an exposed slit may be dramatically reduced or even completely eliminated, buzzing noises derived by flowing an air current through a helmet housing surface and rainwater
(Continued)

invasion may be significantly reduced, and a wearing comfort of the helmet is effectively improved; and besides, the difficulty in assembling the mount and the jaw protector is reduced and a precise gear engagement and constraint structure is adopted, so that the quality reliability of a helmet product can be effectively improved.

20 Claims, 15 Drawing Sheets

(51) Int. Cl.

| | |
|---|---|
| ***A42B 3/20*** | (2006.01) |
| ***A42B 3/22*** | (2006.01) |
| *A42B 3/00* | (2006.01) |

(56) References Cited

U.S. PATENT DOCUMENTS

| | | | | |
|---|---|---|---|---|
| 2008/0276354 | A1 | 11/2008 | Stokes et al. | |
| 2013/0125294 | A1* | 5/2013 | Ferrara | A42B 3/064 2/411 |

FOREIGN PATENT DOCUMENTS

| | | | | | |
|---|---|---|---|---|---|
| CN | 101331994 | A | | 12/2008 | |
| CN | 201010538198 | | | 3/2011 | |
| CN | 201110166785 | A | | 11/2011 | |
| CN | 102305235 | A | | 1/2012 | |
| CN | 201210375127 | A | | 1/2013 | |
| CN | 201310012015 | A | | 4/2013 | |
| CN | 103391727 | A | | 11/2013 | |
| CN | 205757465 | U | | 12/2016 | |
| EP | 3278684 | A1 | * | 2/2018 | A42B 3/326 |
| EP | 3278684 | A4 | * | 3/2018 | A42B 3/326 |
| ES | 2329494 | | | 11/2009 | |
| KR | 101424417 | B1 | | 7/2014 | |
| WO | 2006/045912 | A1 | | 5/2006 | |
| WO | WO 2009095420 | A1 | * | 8/2009 | A42B 3/222 |
| WO | WO 2015110764 | A1 | * | 7/2015 | A42B 3/326 |

* cited by examiner

HELMET WITH TRANSFORMABLE JAW PROTECTING STRUCTURE BASED ON GEAR CONSTRAINT

FIELD OF THE INVENTION

The present invention relates to a helmet for protecting safety of a human head, particularly, to a helmet for drivers of motor vehicles, racing bicycles and air vehicles to wear, and more particularly, to a helmet in which a jaw protecting structure thereof can change a position according to the need.

BACKGROUND OF THE INVENTION

As is known to all, drivers of motor vehicles, racing bicycles and air vehicles all have to wear a helmet to protect the safety of their heads. There are two types of helmet here and now: including a full-face structure helmet and a half-face structure helmet, wherein the full-face structure helmet is provided with a jaw protector surrounding a jaw of a driver while the half-face structure helmet is not provided with such jaw protector; and the full-face helmet may protect the user preferably due to the jaw protector, while the half-face helmet is more conveniently worn due to an opened structure. A typical full-face helmet generally comprises a helmet housing body, a protective guard, a jaw protector and other members, wherein both the protective guard and the jaw protector are installed on the helmet housing body, the protective guard may be opened or buckled according to the need, playing a role in preventing such harmful particles as dust, rainwater and the like as well as raindrop from invading into the helmet to ensure the driver can also drive regularly in poor working conditions, while the jaw protector may effectively protect such vital organs as jaw, mouth, nose and the like of the driver while an accident collision happens. The jaw protector and the helmet housing body of a traditional full-face helmet are in a manufacturing mode of an integral structure, that is to say, the jaw protector is fixed relative to the helmet housing body. Without question, such integral structure of the traditional full-face helmet is firmer, so that it has enough safety; however, the full-face helmet in the integral structure also has defects of inconvenience in use and difficulty in production and manufacture, and the like. On one hand, from a use point of view, when the driver needs to drink water, communicate by phone and take other actions and so on, he has to remove the helmet to complete corresponding actions; at this time, the traditional full-face helmet seems to be very slack and inconvenient; while on the other hand, from a production and manufacture point of view, a production mould for the integrated full-face helmet seems to be very complicated due to a jaw protecting structure, so that its manufacturing cost is very expensive. Obviously, the traditional full-face helmet in the integral structure fails to meet multi-purpose requirements of safety, convenience, low cost and so on. In view of this, Spain patent application ES2329494T3 discloses a helmet with a transformable jaw protecting structure; in addition, China invention patent ZL201010538198.0 also proposes a helmet with a transformable jaw protecting structure capable of mutually transforming a full-face helmet structure and a half-face helmet structure. The two helmets with the transformable jaw protecting structure have common features as follows: firstly, the jaw protector and the helmet housing body adopt a separate structure so that the production and manufacture cost of the helmet may be reduced; secondly, the jaw protector can open and climb over the protective guard even in an opening position from the full-face helmet structure position according to the need to become a half-face helmet, the function is obtained using a slit-like rail slot in a mount and a jaw protector prong and a constraint pin in a movement coordination with the slit-like slot to dynamically control a position and posture of the jaw protector, in other words, a change in the jaw protecting structure totally depends on the rail slot with a through character to constrain. There is no doubt that a scheme that the above two helmets adopt the transformable jaw protecting structure meets the multi-purpose requirements of convenience and low cost preferably, thereby advancing helmet technologies.

However, although the advantages of the above-mentioned two helmets with the transformable jaw protecting structure are readily understood, their disadvantages are also extremely highlighted due to a structure scheme of the slit-like rail slot adopted, with specific performance as follows: 1) the existence of the rail slot with a through character is likely to result in deteriorating the safety of the helmet, for instance, the helmet with the transformable jaw protecting structure disclosed by the Spain patent application ES2329494T3 is provided with a plurality of flat constraint rail slots in its mount and chin of jaw protector, while China patent ZL201010538198.0 is also provided with a similar flat rail slot in its mount, it is obvious that excessive rail slot slit-like structures will inevitably damage the structural intensity and rigidity of corresponding members. This is because that on one hand, it will inevitably damage the integrality of the structural layout, and on the other hand, it will bring concentration of stress. It has to be noted that the scheme of the rail slot will weaken the intensity and rigidity of these important members, so that the safety of the helmet is dramatically reduced; 2) the existence of the rail slot with the through character will inevitably reduce the amenity of the helmet. As is known to all, a powerful relative air current will be produced inevitably in a process that the driver wearing the helmet drives the motor vehicle to run. Since there are multiple slit-like rail slots, the helmet fails to be covered completely and most is in an exposed state. When the air current blowing the helmet flows through surfaces of these rail slots, high air current buzzing noises will be made, and the faster a running speed the higher the noise intensity derived. It is noted that the rail slot is arranged near ears of the driver, so that it will inevitably have a strong impact on the driving comfort of the driver; in addition, the opened rail slot still fails to prevent the rainwater from invading, this not only seriously impacts on a mood of the driver but also seriously interferes with the driving safety of the driver when driving in rainy days, not to mention an increase in driving enjoyment, so that the experience feeling is poor. It is visible that the current helmet with the transformable jaw protector having the rail slot character will result in seriously reducing the amenity; 3) The existence of the rail slot with the through character will inevitably reduce the reliability of the helmet. On one hand, as previously mentioned, the slit-like rail slot will seriously weaken the rigidity and intensity of these important members including the jaw protector and the mount, so that the reliability of the helmet product is reduced; on the other hand, the slit-like rail slot will also increase the assembly complicacy of the helmet, so that the difficulty in assembly is dramatically increased. This is because that a separate impact of the rail slot not only increases a number of parts, but also dramatically increases the complexity of its assembly procedure to make regulation more difficult; in the meanwhile, a constraint pair formed by the slit-like rail slot and a moving pin belongs to an imprecise kinematic pair, a fit clearance of which is difficult to control and easily causes a decrease in the movement stability of the jaw protector very much. It is thus clear that the decrease in the intensity and rigidity of the parts and the increase of the number and assembly difficulty, or the consistency of the fit clearance between the rail slot and the moving pin are difficult to ensure. As a final result, the quality reliability of the helmet is reduced.

In conclusion, using the helmet with the transformable jaw protecting structure based on rail slot constraint in the prior art can achieve the structure transfer of the jaw protector between the full-face helmet position and the half-face helmet position, but has more hidden dangers and disadvantages in terms of safety, comfort, reliability and the like as well. Therefore, it is still necessary to further improve and prompt the helmet.

SUMMARY OF THE INVENTION

In view of the foregoing problems of the existing helmet with the transformable jaw protecting structure, the present invention provides a helmet with a transformable jaw protecting structure based on gear constraint, with the purpose of: on one hand, effectively improving the use safety of the helmet via principle innovation and structure improvement, and on the other hand, effectively improving the wearing comfort of the helmet as well as the quality reliability thereof in the meanwhile.

The object of the present invention is achieved in this way: a helmet with a transformable jaw protecting structure based on gear constraint comprises a helmet housing body, a jaw protector and two mounts, wherein the jaw protector is provided with two prongs disposed at both sides of the helmet housing body respectively, the two mounts are arranged at both side faces of the helmet housing body respectively, and the mounts are fastened and installed on the helmet housing body or the mounts and the helmet housing body are made in an integral structure; wherein two stationary gears fixed relative to the helmet housing body are provided, the two stationary gears are disposed at both sides of the helmet housing body respectively; two rotary gears moving along with the jaw protector are provided, the two rotary gears are also disposed at both sides of the helmet housing body respectively, the mount, the prong, the stationary gear and the rotary gear at the same side of the helmet housing body constitute an associated group; in the same associated group, the rotary gear and the prong are firmly connected with each other or made in an integral structure, the jaw protector drives the rotary gear to move via the prong, when the rotary gear and the stationary gear are in an engaging movement the stationary gear prompts a position and a phase position of the rotary gear to transform, by this time the position and posture of the jaw protector is also transformed under the constraint of the rotary gear so as to adapt to a transformation between a full-face helmet structure and a half-face helmet structure.

Both the stationary gear and the rotary gear are in a form of a cylindrical gear and an engaging mechanism constituted by the stationary gear and the rotary gear belongs to a plane gear transmission mechanism, wherein the stationary gear is an internal gear and the rotary gear is an external gear.

The helmet with the transformable jaw protecting structure based on gear constraint according to claim 2, wherein the stationary gear is mutually engaged with the rotary gear, a pitch radius of the stationary gear is R, a pitch radius of the rotary gear is r, a relatively rotated central angle of axis of the rotary gear is β while a rotated angle of the jaw protector relative to the helmet housing body is α during engagement, and these parameters meet a constraint formula:

$$\frac{R}{r} = 1 + \frac{\alpha}{\beta}.$$

The stationary gear and the mount arranged in the same associated group are tightly connected with each other or made in an integral structure.

The stationary gear comprises a first stationary gear tooth section and a second stationary gear tooth section, the rotary gear comprises a first rotary gear tooth section and a second rotary gear tooth section, the first rotary gear tooth section in the same associated group is engaged with the first stationary gear tooth section only, and the second rotary gear tooth section is engaged with the second stationary gear tooth section only.

In the same associated group, the axis of the first rotary gear tooth section is overlapped with that of the second rotary gear tooth section.

In the same associated group, a first axis locus of the first rotary gear tooth section is tangent with a second axis locus of the second rotary gear tooth section in an intersection point thereof.

The mount or/and the helmet housing body is/are provided with an arc slot, and the arc slot constrains the movement of the rotary gear and keeps the constrained rotary gear engaged with the corresponding stationary gear.

The mount or/and the helmet housing body is/are provided with an elastic locking construction, a layout position of the elastic locking construction is relevant to both end heads of the arc slot, wherein the two end heads of the arc slot are corresponding to a full-face helmet position and a half-face helmet position of the jaw protector respectively.

The helmet is provided with a protective guard, and an assembly of cut surfaces of the protective guard by a horizontal half joint of the helmet housing body in a largest opened position is not globally intersected with a locus assembly of cut surfaces of the jaw protector by a horizontal half joint of the helmet housing body during movement.

An opened movement of the protective guard refers to a fixed-axis rotation, and a driving spring for bouncing up to open the protective guard is provided. The helmet is provided with a latch cam, a locking cam and a locking spring, the latch cam and the protective guard are tightly connected or made in an integral structure, the locking cam and the locking spring are installed on the helmet housing body or/and the mount, the locking spring in a normal state prompts the locking cam and the latch cam to engage and can lock the protective guard in a buckling position thereof when the protective guard is buckled.

The helmet is provided with an unlocking component and an unlocking cam, the unlocking cam is fastened on or made in an integral structure with the locking cam, the unlocking component is driven by the prong of the jaw protector or driven by the rotary gear, and the unlocking component can drive the locking cam to carry out an unlocking action of disengaging the locking cam and the latch cam in a locking state by driving the unlocking cam according to the need.

In a first one third of stroke of returning the jaw protector from the half-face position to the full-face position, the unlocking component at least completes one complete unlocking action for the locking cam and the latch cam.

The unlocking component is a cylindrical pin and an axis of the cylindrical pin and that of the rotary gear are arranged coaxially, and the cylindrical pin and the rotary gear are tightly connected or made in an integral structure.

The helmet is corresponding to the protective guard in the buckling position, the locking cam and the latch cam have two engagement locking states, the first locking state is that the protective guard is locked in the buckling position and a lower edge of the protective guard is adhered to a lip side of the jaw protector, and the second locking state is that the jaw protector is locked in the buckling position and an air permeable gap is arranged between a lower edge of the protective guard and a lip side of the jaw protector.

The helmet is provided with a delay component for slowing down an impact of an up-bouncing terminal of the protective guard on the mount or/and the helmet housing body.

The helmet is provided with an expansion construction forcing the prong to externally expand and elastically deform to help the lip side of the jaw protector smoothly climb over the lower edge of the protective guard in an opened state on the mount or/and the helmet housing body.

The helmet with the transformable jaw protecting structure based on the gear constraint according to the present invention can reliably enable the jaw protector between the full-face helmet position and the half-face helmet position in a gear constraint structure and mode, and can keep the uniqueness and reversibility of a geometrical locus of the jaw protector. On the one hand, the integrity of a whole structure of the mount and the jaw protector can be kept, thus ensuring that these core members have higher intensity and rigidity, and effectively enhancing the use safety of the helmet; on the other hand, an exposed slit in a helmet housing surface may be dramatically reduced or even completely eliminated, so that buzzing noises derived by flowing an air current through a helmet housing surface and rainwater invasion may be significantly reduced, and a wearing comfort of the helmet is effectively improved; and in addition, the structural integrity of the mount and the jaw protector is increased and the difficulty in assembling the mount and the jaw protector is reduced, while a gear engagement belongs to a reliable constraint structure, so that the quality reliability of the helmet can be effectively improved.

DETAILED DESCRIPTION OF THE EMBODIMENTS

Figure 1:
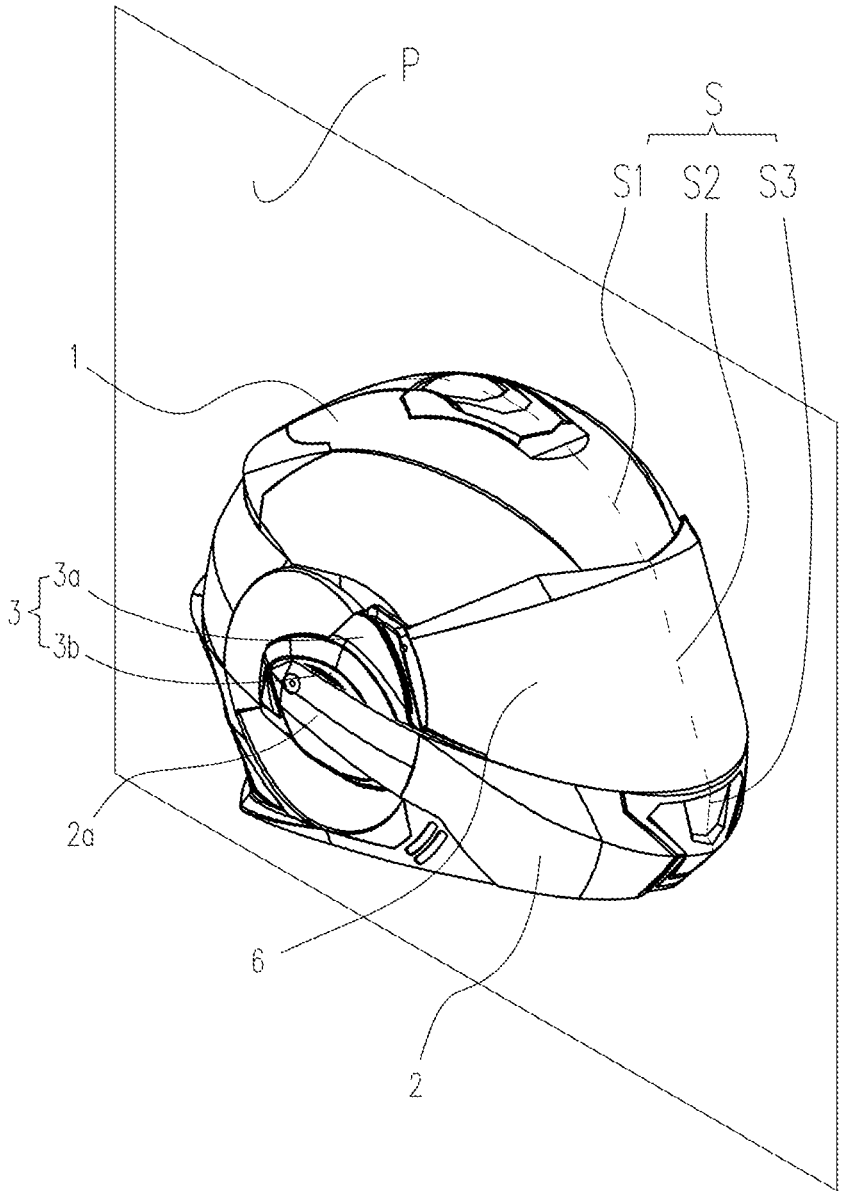
FIG. 1 is an isometric view of a helmet with a transformable jaw protecting structure based on gear constraint according to the present invention.
Figure 3:
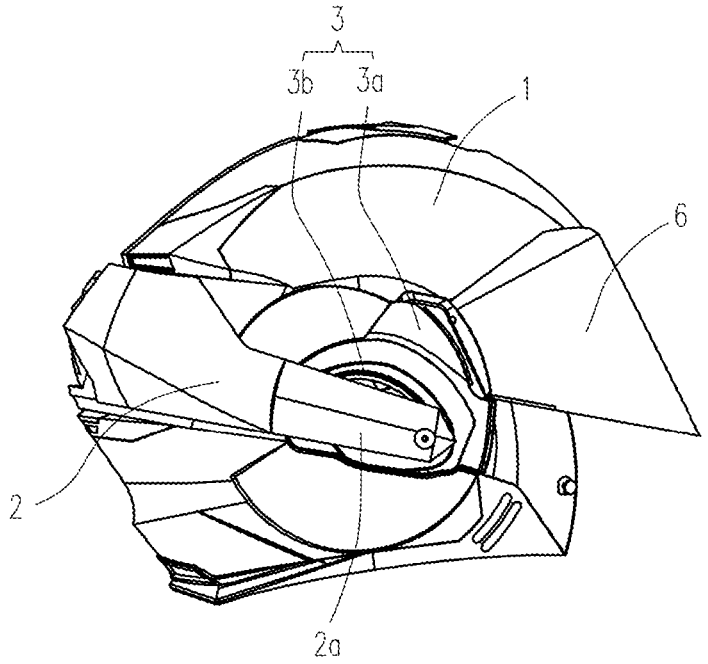
FIG. 3 is a side schematic diagram of the helmet with the transformable jaw protecting structure based on gear constraint according to the present invention as illustrated in FIG. 1 in a half-face helmet structure state.
Figure 4:
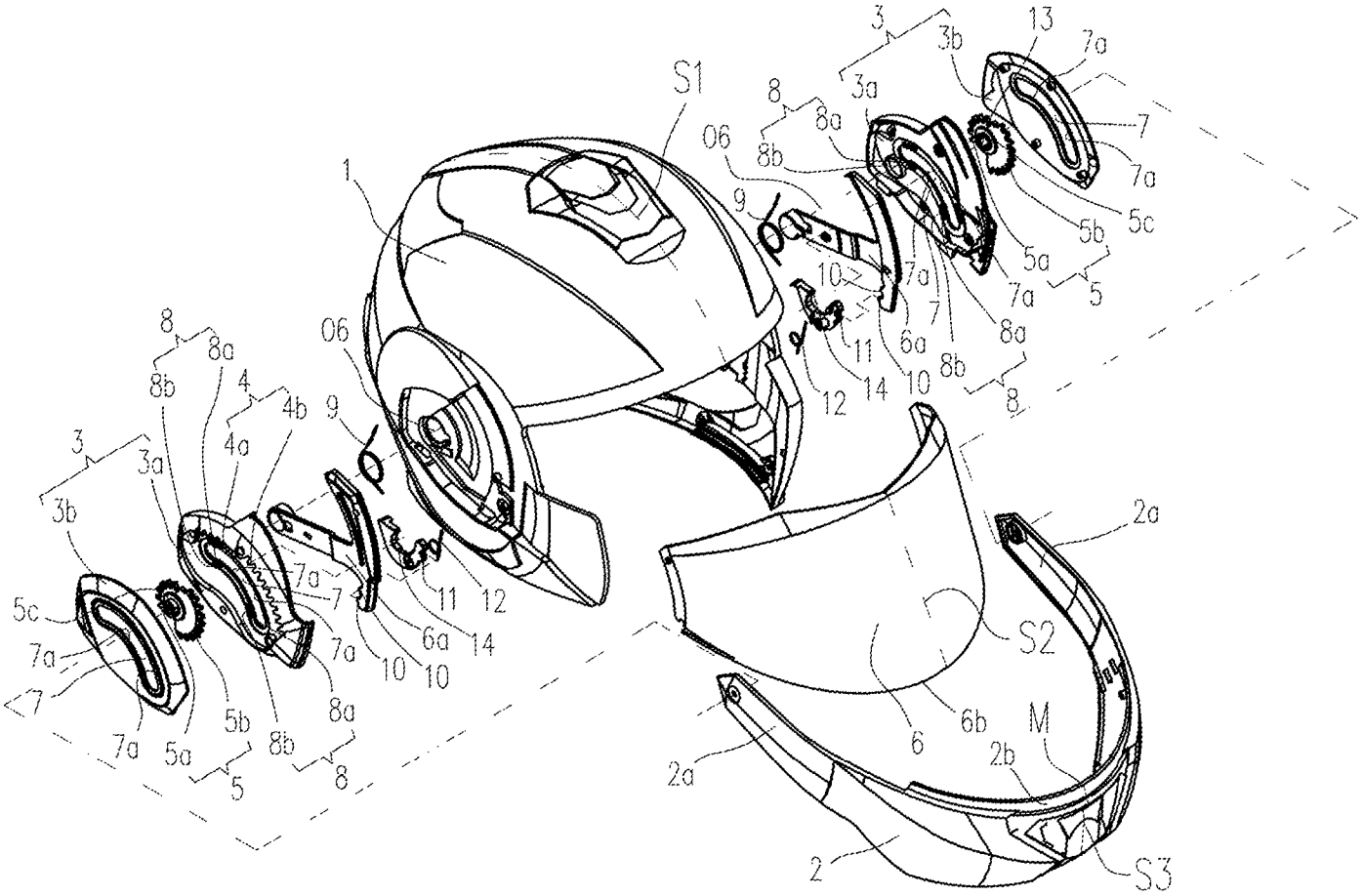
FIG. 4 is an explosion schematic diagram of the helmet with the transformable jaw protecting structure based on gear constraint according to the present invention as illustrated in FIG. 1.
Figure 6:
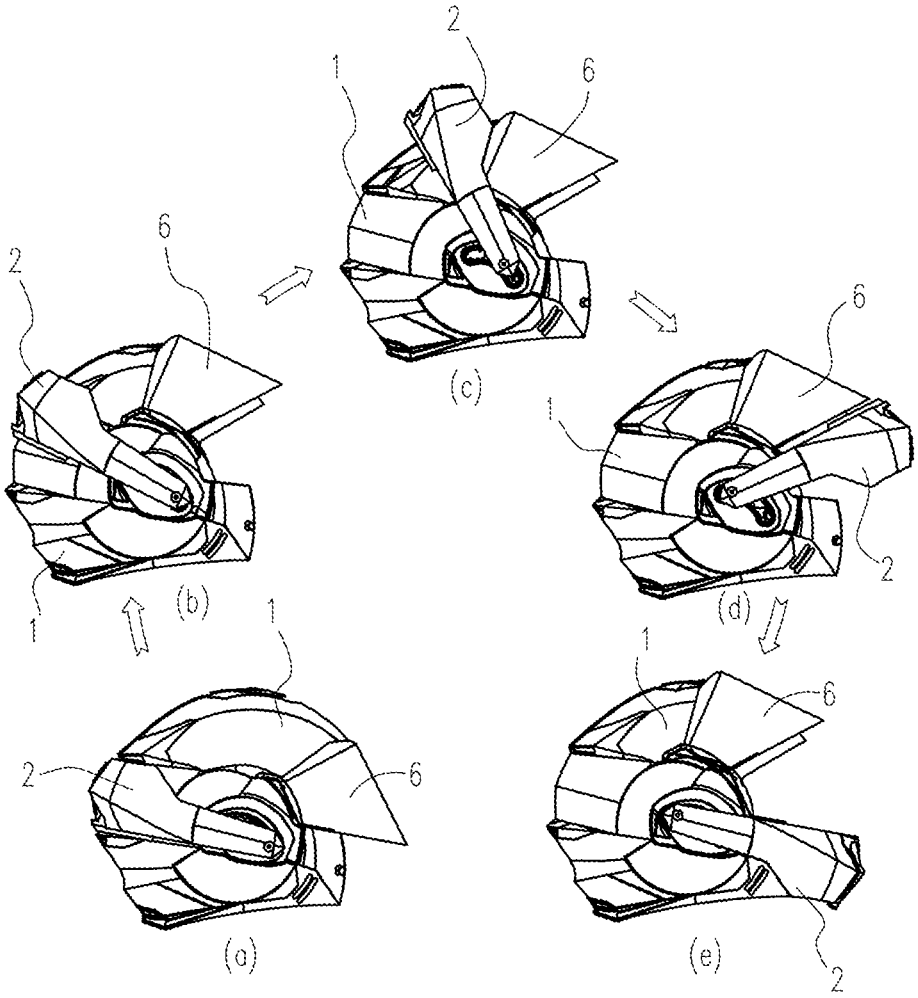
FIG. 6 is a schematic diagram of a process state of a jaw protector of a helmet with a transformable jaw protecting structure based on gear constraint according to the present invention returning to a full-face helmet structure position from a half-face helmet structure position.
Figure 7:
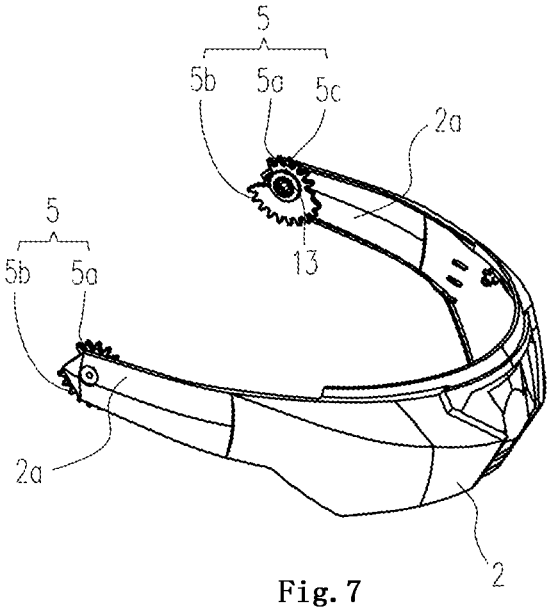
FIG. 7 is an isometric view of mutually tightly connecting a rotary gear and a prong of a helmet with a transformable jaw protecting structure based on gear constraint according to the present invention.
Figure 8:
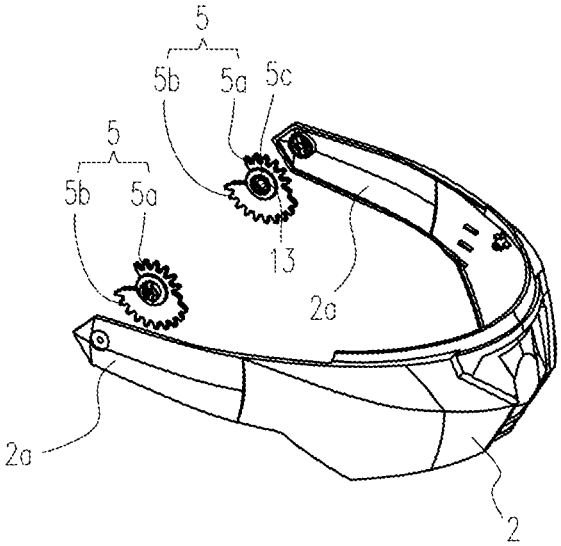
FIG. 8 is an explosion schematic diagram of a connecting assembly formed by the rotary gear and the prong as illustrated in FIG. 7.

The present invention is further described with reference to exemplary embodiments hereinafter, see FIG. 1 to FIG. 17:

A helmet with a transformable jaw protecting structure based on gear constraint comprises a helmet housing body 1, a jaw protector 2 and two mounts 3, wherein the mount 3 may be either a single part (without being illustrated in figure) or a member composed of a plurality of parts (the mount 3 as illustrated in FIG. 4 belongs to a member including a bottom cover 3*a* and an external cover 3*b*), the jaw protector 2 is provided with two prongs 2*a* disposed at both sides of the helmet housing body 1 respectively, the two mounts 3 are arranged at both side faces of the helmet housing body respectively (see FIG. 4), and the mounts 3 are fastened and installed on the helmet housing body 1 or the mounts 3 and the helmet housing body 1 are made in an integral structure; here, the helmet housing body 1 is provided with a horizontal half joint P, the horizontal half joint P divides left and right eyes and left and right ears of a driver into at both sides thereof through a mouth, nose and head of the driver when the driver wears the helmet regularly, in other words, the horizontal half joint P of the present invention can be deemed to be a left and right symmetry plane of the helmet housing body 1 (as illustrated in FIG. 1). It should be noted that the protective guard 6 here is made of a transparent material, with a function of preventing rainwater, dust and the like from invading into the helmet housing body 1 when driving a vehicle. "The jaw protector 2 is provided with two prongs 2*a* disposed at both sides of the helmet housing body 1 respectively" as described in the present invention means that the two prongs 2*a* are separated by the horizontal half joint P and disposed close to an external surface of the helmet housing body 1 or closely adhered to an external surface of the helmet housing body 1. In the same way, "the mounts 3 are fastened and installed on the helmet housing body 1" means the two mounts 3 are separated by the horizontal half joint P and are arranged at both side faces of the helmet housing body 1 respectively and tightly connected with the helmet housing body 1, wherein the two mounts are located on the helmet housing body 1 respectively, a portion corresponding to left and right ears of the driver is a best arrangement position when the driver wears the helmet (as illustrated in FIG. 4), while a tight connection between the mount 3 and the helmet housing body 1 can employ various existing known fastening connection structures and connection methods, particularly including screw fastening connection, bolt fastening connection, rivet fastening connection, bonding fastening connection, welding fastening connection, snap fastening connection, blocking fastening connection and several (including one or combined) fastening connection structures and connection modes. For the helmet housing body 1 made of a material like plastic, the welding fastening connection can be heating welding, ultrasonic welding or friction welding forms and methods. Particularly, in the present invention the two mounts 3 can also be in a bonding form of manufacturing in an integral structure with the helmet housing body 1, which comprises various forms that a bottom cover 3*a* or/and an external cover 3*b* of the mount 3 and the helmet housing body 1 are made in an integral structure (without being illustrated in figure); the maximum character of the present invention is that: in order to transform a structure of the jaw protector 2, two stationary gears 4 fixed relative to the helmet housing body 1 are provided respectively, the two stationary gears 4 are disposed at both sides of the helmet housing body 1 respectively (i.e., separated by the horizontal half joint P), in addition, two rotary gears 5 moving along with the jaw protector 2 together are provided (as illustrated in FIG. 4), the two rotary gears 5 are also disposed at both sides of the helmet housing body 1 respectively (i.e., separated by the horizontal half joint P), the mount 3, the prong 2*a*, the stationary gear 4 and the rotary gear 5 at the same side of the helmet housing body 1 constitute an associated group, that is to say, the mount 3, the prong 2*a*, the stationary gear 4 and the rotary gear 5 at the same side of the helmet housing body 1 are in one or more of direct or indirect incidence relations of support bearing, connection fastening, fit constraint, movement transmission, stress transition and the like. It is very obvious that there are a total of two associated groups in the helmet of the present invention, while the two associated groups are disposed at both sides of the horizontal half joint P of the helmet respectively and located in or near a position corresponding to the left and right ears of the driver (see FIG. 4). In the same associated group, the rotary gear 5 and the prong 2*a* are tightly connected with each other (as illustrated in FIG. 7 and FIG. 8) or the rotary gear 5 and the prong 2*a* are made in an integral structure (without being illustrated in figure). In addition, the rotary gear 5 and the stationary gear 4 are in engagement fit (see FIG. 9 to FIG. 11). When the driver needs to change the structure state of the jaw protector 2 in order to obtain a full-face structure helmet or a half-face structure helmet, the driver moves or turns over the jaw protector 2 with hands and enables the jaw protector 2 to move relative to the helmet housing body 1 (the movement is combined with two actions of shift and turn), at this time, the jaw protector 2 drives the rotary gear 5 to move via the prong 2*a*. When the rotary gear 5 and the stationary gear 4 are in engagement movement, the stationary gear 4 prompts the position and phase position of the rotary gear 5 to change (i.e., a position coordinate of the rotary gear 5 relative to the helmet housing body 1 will be changed, in the meanwhile, the rotary gear 5 also turns a certain angle relative to the helmet housing body 1 or the rotary gear 5 occurs a change of phase position relative to the helmet housing body 1), at this time, the corresponding position and posture of the jaw protector 2 will be changed under the constraint of the rotary gear 5 to adapt to the transformation (see FIG. 5 and FIG. 6) of the helmet between the full-face helmet structure (see FIG. 2) and the half-face helmet structure (see FIG. 3).

Figure 5:
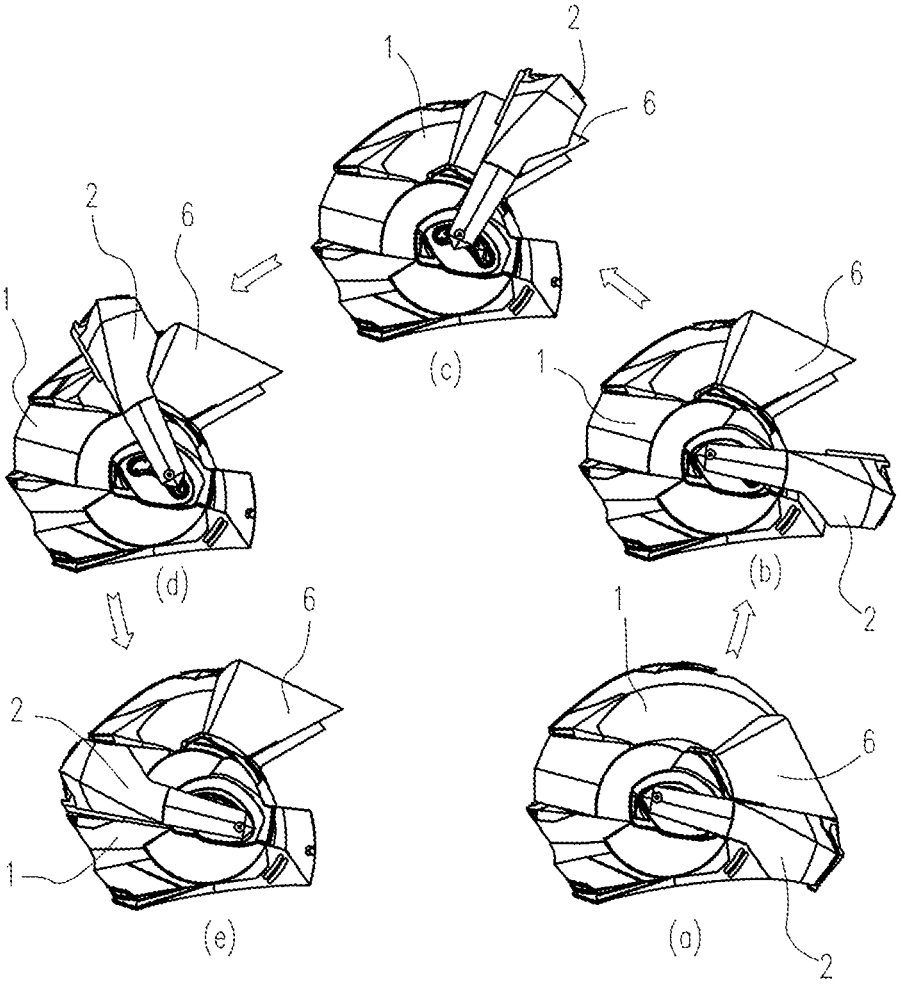
FIG. 5 is a schematic diagram of a process state of a jaw protector of a helmet with a transformable jaw protecting structure based on gear constraint according to the present invention changing from a full-face helmet structure position to a half-face helmet structure position.

A process state of turning over the jaw protector 2 from the full-face helmet structure position to the half-face helmet structure position by the driver is given in FIG. 5: wherein, FIG. 5(*a*) represents that the jaw protector 2 is in the full-face helmet structure position; FIG. 5(*b*) represents that the jaw protector 2 is at an initial stage of separating from the full-face helmet structure position (at this time, the protective guard 6 is bounced up by a corresponding spring to a highest point); FIG. 5(*c*) represents that the jaw protector 2 is climbing over the protective guard 6 at a highest opened position; FIG. 5(*d*) represents that the jaw protector 2 has crossed over the protective guard 6 and a highest dome point of the helmet housing body 1; FIG. 5(*e*) represents the jaw protector 2 is fallen and adhered to the helmet housing body 1 and reaches to the half-face helmet structure position. A process state of moving and returning the jaw protector 2 to the full-face helmet structure position from the half-face helmet structure position is given in FIG. 6: wherein, FIG. 6(*a*) represents the jaw protector 2 is in the half-face helmet structure position; FIG. 6(*b*) represents that the jaw protector 2 is at an initial stage of separating from the full-face helmet structure position and within a first one third of full returning stroke (at this time, the protective guard 6 is unlocked and bounced up by a corresponding spring to a highest point); FIG. 6(*c*) represents that the jaw protector 2 is climbing over the highest dome point of the helmet housing body 1; FIG. 6(*d*) represents the jaw protector 2 has just climbed over the protective guard 6 at a highest opened position; FIG. 6(*e*) represents the jaw protector 2 has fallen to the half-face helmet structure position. Different engagement position states of the rotary gear 5 and the stationary gear 4 are given in FIG. 10: wherein the engagement in FIG. 10(*a*) is corresponding to the jaw protector 2 in a full-face helmet structure, such as a state of the jaw protector 2 as illustrated in FIG. 5(*a*) and FIG. 6(*e*), the engagement in FIG. 10(*c*) is corresponding to the jaw protector 2 in a half-face helmet structure, such as a state of the jaw protector 2 as illustrated in FIG. 5(*e*) and FIG. 6(*a*), and the engagement in FIG. 10(*b*) is corresponding to the jaw protector 2 in some middle position between a full-face helmet structure position and a half-face helmet structure position. During the course of moving the jaw protector 2 between the full-face helmet structure position and the half-face helmet structure position, a geometrical locus formed in a to-and-fro movement of the jaw protector 2 can keep unique and reversible, in other words, this means both the position and turn angle of the jaw protector 2 relative to the helmet housing body 1 under common constraint of the rotary gear 5 and the stationary gear 4 are controlled and controllable, as well as unique and reversible, this significant character and cause creates a condition to design and achieve the transformation of the helmet between a half-face helmet structure and a full-face helmet structure.

Figure 2:
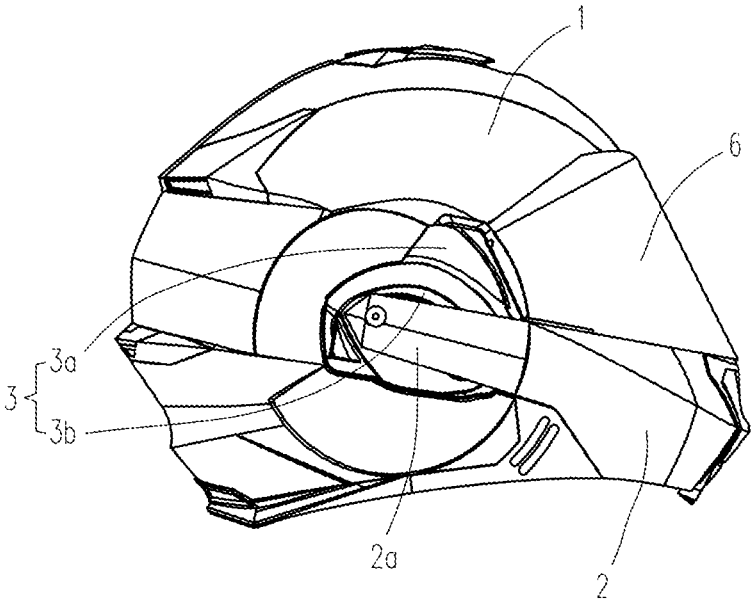
FIG. 2 is a side schematic diagram of the helmet with the transformable jaw protecting structure based on gear constraint according to the present invention as illustrated in FIG. 1 in a full-face helmet structure state.
Figure 9:
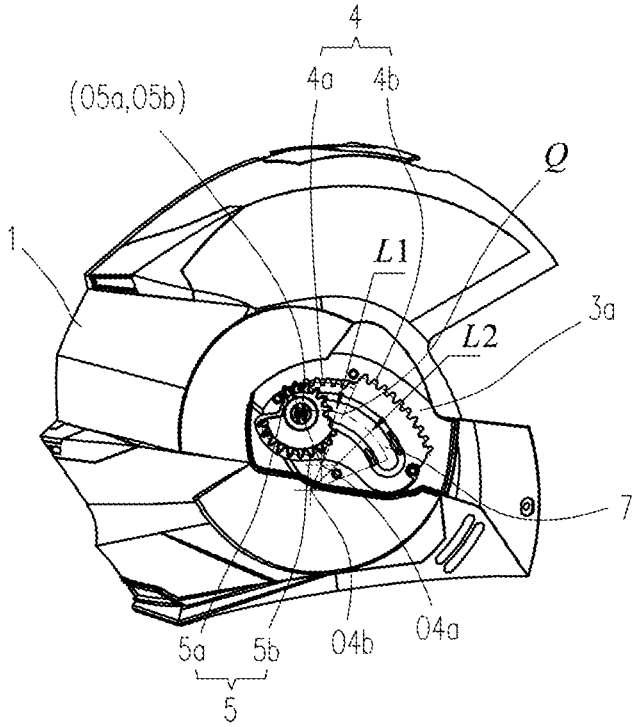
FIG. 9 is a schematic diagram of both a rotary gear and a stationary gear of a helmet with a transformable jaw protecting structure based on gear constraint according to the present invention being two sections of cylindrical gears in a gear tooth section form and being mutually engaged.
Figure 10:
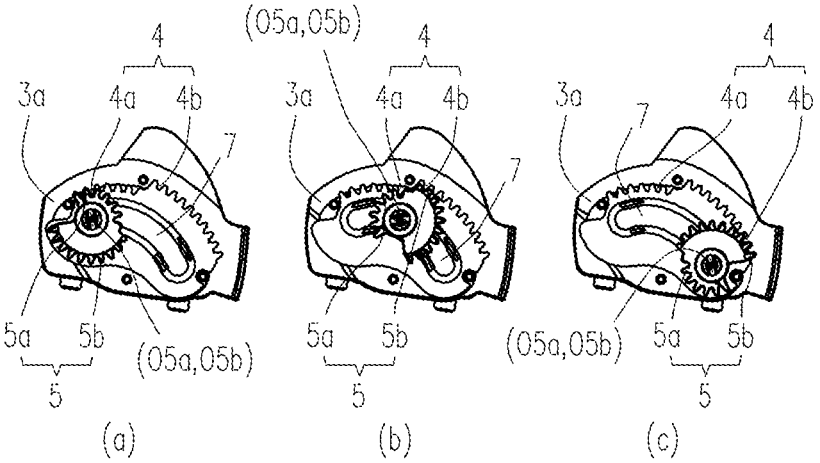
FIG. 10 is a schematic diagram of the rotary gear and the stationary gear as illustrated in FIG. 9 being mutually engaged when the jaw protector being in a full-face helmet structure position state, some middle structure position state and a half-face helmet structure position state.
Figure 11:
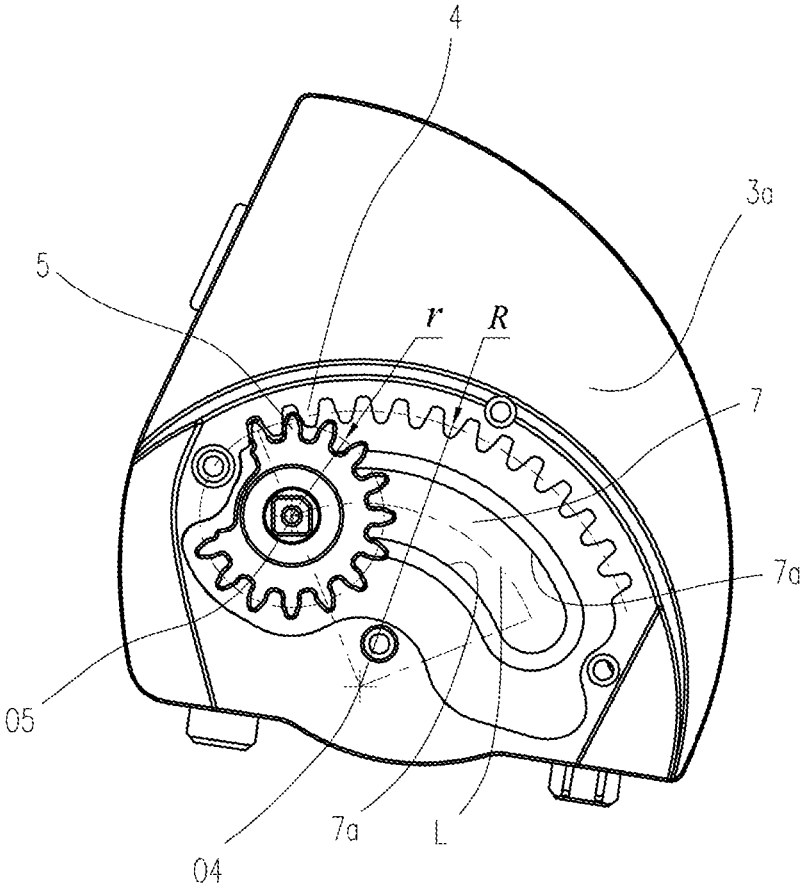
FIG. 11 is a schematic diagram of both a rotary gear and a stationary gear of a helmet with a transformable jaw protecting structure based on gear constraint according to the present invention being one section of cylindrical gear in a gear tooth section form and being mutually engaged.
Figure 12:
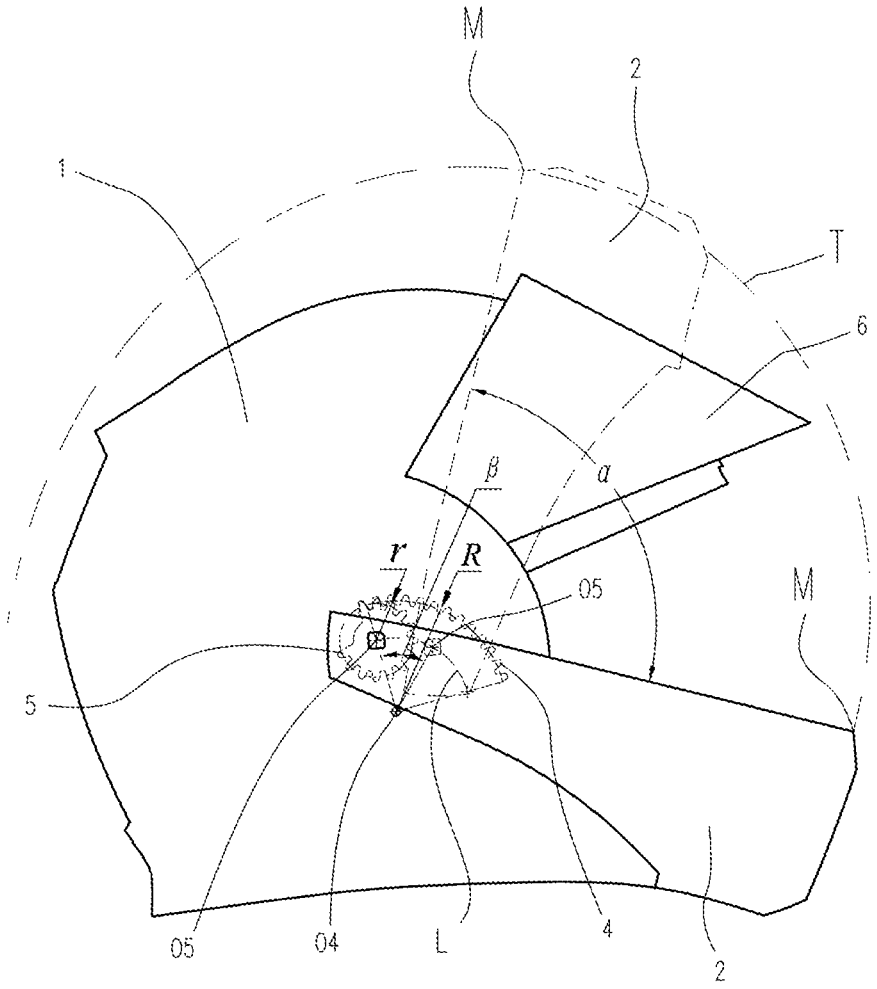
FIG. 12 is a schematic diagram of a geometric parameter of the jaw protector moving relative to the helmet housing body when the rotary gear and the stationary gear of an embodiment as illustrated in FIG. 11 being in mutual engagement movement.
Figure 13:
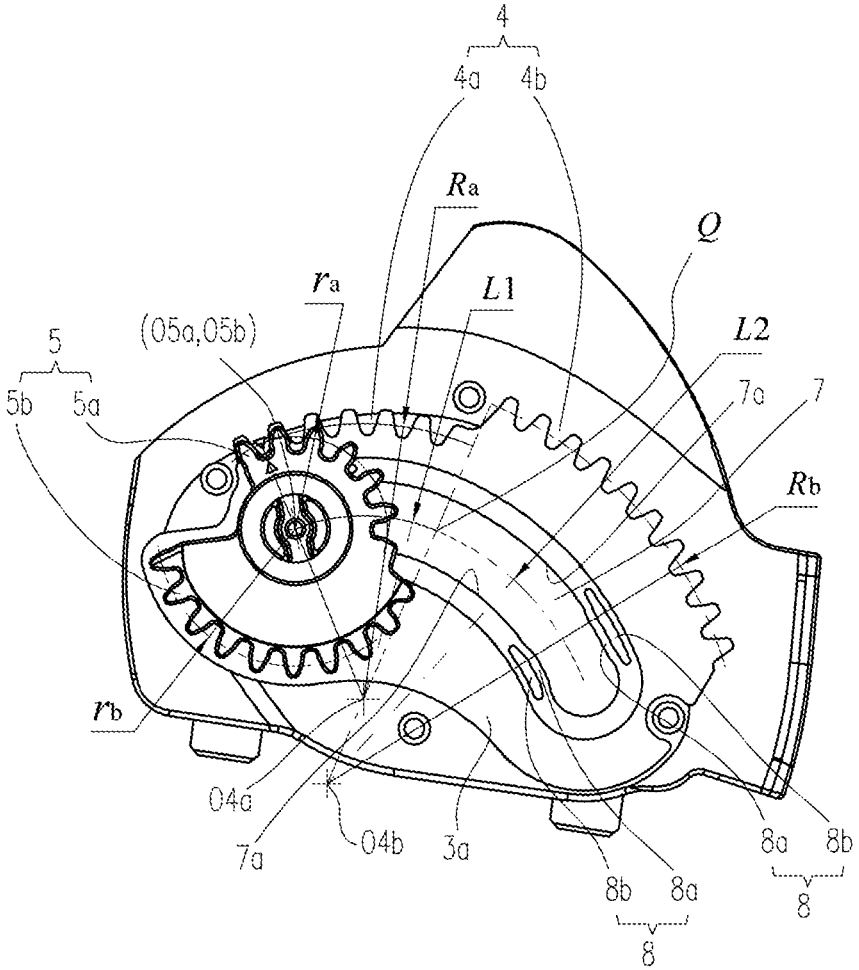
FIG. 13 is a schematic diagram of a geometric parameter of both a rotary gear and a stationary gear of a helmet with a transformable jaw protecting structure based on gear constraint according to the present invention being two sections of cylindrical gears in a gear tooth section form and being mutually engaged.

The above-mentioned full-face helmet structure means that the jaw protector 2 is in the front of the helmet and surrounds such organs as chin, mouth and the like of the driver to be in a protected state (as illustrated in FIG. 2), while the half-face helmet structure means that the jaw protector 2 is opened and turned over to a certain portion between the top (corresponding to the cranial vault of the driver) of the helmet housing body 1 and the rear (corresponding to the back side of head of the driver) (as illustrated in FIG. 3), such helmet at this time is the half-face structure helmet as long as the mouth, nose, eyes and other organs of the driver are not shielded by the jaw protector 2 and in an exposed structure state in such portion, obviously, the helmet with the jaw protector 2 in the half-face helmet structure state is able to be convenient for the driver to drink water, communicate by phone and take other actions and so on. It has to be pointed out that, if the position movement and posture change of the jaw protector 2 have or include a structure and principle constrained and realized by means of the rotary gear 5 and the stationary gear 4, then it accords with and fall into a scope of the helmet with the transformable jaw protecting structure based on the gear constraint. In addition, it should be noted that, "in this process, the position and posture of the jaw protector 2 will also be changed under the constraint of the rotary gear 5, at this time, a geometrical locus formed in a to-and-fro movement of the jaw protector 2 can keep unique and reversible" as described in the present invention means that: in the movement process of engaging the rotary gear 5 with the stationary gear 4, since the position and posture of the jaw protector 2 is changed under the constraint of the rotary gear 5, at this time, a geometrical locus of the jaw protector 2 formed by the movement relative to the helmet housing body 1 has the uniqueness, that is to say, the movement of the jaw protector 2 is confirmed and unique, that is also to say, there is only one mechanism freedom of the jaw protector 2, while from another perspective, a specific point location of the engagement between the rotary gear 5 and the stationary gear 4 determines a specific position and posture of the jaw protector 2, in turn, some specific position of the jaw protector 2 and an angle posture of this position are also corresponding to an unique engagement point location of the rotary gear 5 and the stationary gear 4, in addition, during the engagement between the rotary gear 5 and the stationary gear 4, whether moving the jaw protector 2 from the full-face helmet position to the half-face helmet position (see FIG. 5) or returning to the full-face helmet position from the half-face helmet position (see FIG. 6), a position coordinate value and posture angle value of the jaw protector 2 in the point location relative to the helmet housing body 1 are determined uniquely when the jaw protector 2 moves to the certain specific point location, this represents the uniqueness what is said, but when the jaw protector 2 returns to the full-face helmet position from the half-face helmet position, the geometrical locus of the jaw protector 2 can inverse the position and posture of moving from the full-face helmet position to the half-face helmet position in all aspects, or to say, the geometrical locus of the jaw protector 2 formed in the above two positive and negative movements can be mutually reappeared and repeated, that is also to say, it has reversibility. It should be pointed out that, "a geometrical locus formed in a to-and-fro movement of the jaw protector 2 can keep unique and reversible" allows a little imprecision or tiny inaccuracy caused by various factors, such as manufacturing error, assembling clearance, stress deformation and the like, that is to say, the geometrical locus formed in the to-and-fro movement of the jaw protector 2 allows bias of not affecting the normal use of the helmet within a certain scope, or to say, the repeatability and uniqueness of the geometrical locus of the jaw protector 2 allows certain errors, but a precondition is that these errors cannot affect the transformation of the jaw protector 2 between the full-face helmet position and the half-face helmet position. In the present invention, an intersected intersection line S is arranged between the horizontal half joint P and an external surface of the helmet housing body 1, the jaw protector 2, the protective guard 6 and other components (see FIG. 1 and FIG. 4), the intersection line S is composed of three portions, including an intersection line S1 of the horizontal half joint P and the helmet housing body 1, an intersection line S2 of the horizontal half joint P and the protective guard 6, and an intersection line S3 of the horizontal half joint P and the jaw protector 2, therefore, the intersection line S can also be marked as S (S1, S2 and S3). In the present invention, the stationary gear 4 is motionless or immobile relative to the helmet housing body 1, and has various forms of structural layout: 1) the stationary gear 4 is an independent component and is tightly installed on the helmet housing body 1 in a direct manner (without being illustrated in FIG. 2); 2) the stationary gear 4 and the helmet housing body 1 are made in an integral structure (without being illustrated in figure); 3) the stationary gear 4 is an independent component and is fastened on the helmet housing body 1 and the mount 3 in the meanwhile (without being illustrated in figure); 4) the stationary gear 4 is an independent piece and is tightly connected with the mount 3, and then firmly installed on the helmet housing body 1 (without being illustrated in figure); and 5) the stationary gear 4 and the mount 3 are made in an integral structure and then are firmly installed on the helmet housing body 1 (a situation of making the stationary gear 4 and a bottom cover 3*a* of the mount 3 in an integral structure is exactly given in FIG. 4, FIG. 9 and FIG. 10). The last two of the above five situations of structural layout for the stationary gear 4 are better structural layout, at this time, the stationary gear 4 and the mount 3 are tightly connected or made in an integral structure, therefore, the mount 3, the prong 2*a*, the stationary gear 4 and the rotary gear 5 in the same associated group can be pre-assembled in advance while producing the helmet, and then are tightly installed on the helmet housing body 1, so the difficulty in assembly can be reduced to ensure the installation quality and improve the efficiency in assembly; in addition, the best relative position layout of the stationary gear 4, the rotary gear 5 and the mount 3 is that: the stationary gear 4 and the rotary gear 5 are mutually engaged and distributed between the bottom cover 3*a* and the external cover 3*b* of the mount together, i.e., the stationary gear 4 and the rotary gear 5 are clamped in the middle by the bottom cover 3*a* and the external cover 3*b* (see FIG. 4). In addition, it should be pointed out that, in the present invention, the stationary gear 4 and the rotary gear 5 can have various structure forms, such as a straight gear structure, a helical gear structure or other gear structures, etc., wherein taking the stationary gear 4 and the rotary gear 5 as cylindrical gears (at this time, both a reference circle and a pitch circle thereof are circular or arc-shaped) is the best structure form (as illustrated in FIG. 4, FIG. 9 to FIG. 13), of course, in order to obtain some special locus constraint targets and effects, the stationary gear 4 and the rotary gear 5 can also even be in a special shape gear structure of other various non-cylindrical gears (at this time, the mutually engaged pitch circles thereof can be elliptic, polygonal or in other special shapes, without being illustrated in figure), but no matter which form the gear is adopted, the selection shall follow the code of contributing to constraining the jaw protector 2 to achieve the transformation between the full-face helmet structure and the half-face helmet structure, while from the perspective of easiness in manufacture and convenience in installation, the best structure form and assembly form of the stationary gear 4 and the rotary gear 5 is as follows: both the stationary gear 4 and the rotary gear 5 are in the form of cylindrical gear, and the constituted engaging mechanism belongs to a plane gear transmission mechanism (i.e., an axial line of the involved gear is arranged in parallel to each other), wherein the stationary gear 4 is in an internal gear configuration while the rotary gear 5 is in an external gear configuration (as illustrated in FIG. 4, FIG. 9 to FIG. 13), at this time, when the rotary gear 5 is in engagement rotation along the stationary gear 4, a locus of a rotary gear axis 05 (i.e., a locus L of a so-called rotary gear axis) appears as a section of arc line and the center of the arc line is overlapped with a stationary gear axis 04 of the engaged stationary gear 4 (see FIG. 11 and FIG. 12). It must be emphasized that: "both the stationary gear 4 and the rotary gear 5 are in the form of cylindrical gear, and the constituted engaging mechanism belongs to a plane gear transmission mechanism" as described in the present invention refers to a comprehensive statement, that is to say, the axial line of the involved stationary gear 4 and the rotary gear 5 is allowed to be unparallel to a certain extent (including a stationary state and a running state), that is also to say, a phenomenon of the unparallel axle line of the stationary gear 4 and the rotary gear 5 in some point location or local area due to various reasons of manufacturing error, assembly error, stress deformation and temperature rise deformation and the like can be allowed, in addition, it is also considered that the unparallel axle line of the stationary gear 4 and the rotary gear 5 in the local area caused by various factors, such as modeling need, obstacle crossing need, position locking need and the like, is also allowed, wherein "modeling need" refers to a reason caused when the jaw protector 2 follows the overall appearance modeling of the helmet, "obstacle crossing need" refers to a reason caused when the jaw protector 2 climbs over some limit points including a highest point, a latest point and a widest point of the protective guard 6 and the helmet housing body 1, "position locking need" refers to a reason caused by needing to cross over some clamping components to generate elasticity to adapt to deform when the jaw protector 2 is in the full-face helmet structure position and the half-face helmet structure position as well as near these limit positions. The unparallel phenomenon of the axial line of the stationary gear 4 and the rotary gear 5 caused by the above reasons and within the allowable error scope (i.e., not affecting the normal engagement movement of the gear) in the present invention will be deemed to fall into the scope of "an engaging mechanism constituted by the stationary gear 4 and the rotary gear 5 belongs to a plane gear transmission mechanism". In order to be able to precisely constrain the action and locus of the jaw protector 2, parameters of the stationary gear 4 and the rotary gear 5 in the present invention can adopt such design principle, i.e.: for these stationary gear 4 and the rotary gear 5 that are mutually engaged, a pitch radius of the stationary gear 4 is R, a pitch radius of the rotary gear 5 is r, a relatively rotated central angle of the rotary gear axis 05 is β while a rotated angle of the jaw protector 2 relative to the helmet housing body 1 is α during engagement (see FIG. 11 and FIG. 12), and these parameters meet a constraint formula:

$$\frac{R}{r} = 1 + \frac{\alpha}{\beta};$$

obviously, the stationary gear 4 and the rotary gear 5 that are mutually engaged shall have same modulus, however when both the stationary gear 4 and the rotary gear 5 are standard gears at the same time, at the moment, the pitch radius R of the stationary gear 4 is a reference circle radius of the stationary gear 4, and the pitch radius r of the rotary gear 5 is a reference circle radius of the rotary gear 5. It should be pointed out that, in the present invention, the stationary gear 4 can be either a gear with only a unique gear tooth section (as illustrated in FIG. 11 and FIG. 12) or a gear including a plurality of gear tooth sections, similarly, the rotary gear 5 can be either a gear with only a unique gear tooth section (as illustrated in FIG. 11 and FIG. 12) or a gear including a plurality of gear tooth sections, however, with respect to the stationary gear 4 including the plurality of gear tooth sections, design parameters (such as, modulus, tooth number, reference circle, pitch circle, length of the gear tooth section, and the like) among different gear tooth sections) can be either the same or different (and with respect to the rotary gear 5 including the plurality of gear tooth sections, it is the same), the advantages of such arrangement is that the better locus of the jaw protector 2 can be designed according to the appearance needs of the helmet housing body 1 and the flexibility of design and layout can also be improved. In the present invention, the movement locus of the rotary gear axis 05 when being in engagement rotation along the stationary gear 4 is called as the locus L of the rotary gear axis (see FIG. 11 and FIG. 12). Obviously, for the engagement of the stationary gear 4 and the rotary gear 5 belonging to the plane gear transmission mechanism and in the form of cylindrical gear, when the stationary gear 4 only has one gear tooth section, the rotary gear 5 engaged with the stationary gear 4 also only has one gear tooth section (as illustrated in FIG. 11 and FIG. 12), at this time, the locus L of the rotary gear axis is a section of arc-shaped continuous curve, an arc center of the locus L of the rotary gear axis is the stationary gear axis 04, and this parameter, the foregoing central angle β of the rotary gear axis 05 is also measured taking the stationary gear axis 04 as a reference coordinate (see FIG. 11 and FIG. 12), while for the engagement of the stationary gear 4 including the plurality of gear tooth sections and the rotary gear 5, the locus L of the rotary gear axis is formed by a plurality of sections of arc-shaped curves at this time. Particularly, when both the stationary gear 4 and the rotary gear 5 have two gear tooth sections (as illustrated in FIG. 4, FIG. 9, FIG. 10 and FIG. 13), dual requirements of the jaw protector 2 for simple and reliable structure and complicated locus planning can be met. A situation of the rotary gear 5 in the form of cylindrical gear including two gear tooth sections and belonging to the plane gear transmission mechanism is given in FIG. 4, FIG. 7 to FIG. 10, and FIG. 13, while a situation of the stationary gear 4 in the form of cylindrical gear including two gear tooth sections and belonging to the plane gear transmission mechanism is also given in FIG. 4, FIG. 9, FIG. 10, and FIG. 13: wherein, the stationary gear 4 includes a first stationary gear tooth section 4*a* and a second stationary gear tooth section 4*b*, the rotary gear 5 includes a first rotary gear tooth section 5*a* and a second rotary gear tooth section 5*b*, and in the same associated group the first rotary gear tooth section 5*a* is only engaged with the first stationary gear tooth section 4*a*, while the second rotary gear tooth section 5*b* is only engaged with the second stationary gear tooth section 4*b*, here a modulus of the first stationary gear tooth section 4*a* and the first rotary gear tooth section 5*a* and that of the second stationary gear tooth section 4*b* and the second rotary gear tooth section 5*b* can be either the same (at this time, a tooth form thereof is the same, as illustrated in FIG. 9 and FIG. 10) or be different (at this time, a tooth form thereof is different, without being illustrated in figure), a tooth number of the first stationary gear tooth section 4*a* and that of the secondary stationary gear tooth section 4*b* can be either equal or not, a tooth number of the first rotary gear tooth section 5*a* and that of the second rotary gear tooth section 5*b* can be either equal or not, in addition, the stationary gear 4 has two gear axes including a first stationary gear axis 04*a* corresponding to the first stationary gear tooth section 4*a* and a second stationary gear axis 04*b* corresponding to the second stationary gear tooth section 4*b* (as illustrated in FIG. 9 and FIG. 13), and the rotary gear 5 also has two gear axes including a first rotary gear axis 05*a* corresponding to the first rotary gear tooth section 5*a* and a second rotary gear axis 05*b* corresponding to the second rotary gear tooth section 5*b* (as illustrated in FIG. 9, FIG. 10 and FIG. 13). It should be pointed out that, for the stationary gear 4 and rotary gear 5 in the form of cylindrical gear having the plurality of gear tooth sections and belonging to the plane gear transmission mechanism, the pitch radius of the stationary gear tooth section and the rotary gear tooth section that are mutually engaged as well as an angle of the jaw protector 2 turned relative to the helmet relative to the helmet housing body 1 during the engagement thereof and a central angle turned by the rotary gear axis 05 still comply with the parameter constraint formula given above. By taking the stationary gear 4 and rotary gear 5 in the form of cylindrical gear having two gear tooth sections and belonging to the plane gear transmission mechanism for example, it is assumed that a pitch radius of the first stationary gear tooth section 4*a* and the first rotary gear tooth section 5*a* that are mutually engaged is $R_a$ and $r_a$ respectively (see FIG. 13), and when an angle of the jaw protector 2 turned relative to the helmet housing body 1 during the engagement thereof is $\alpha_a$, a central angle turned by the first rotary gear axis 05*a* is $\beta_a$ relatively (the parameters $\alpha_a$ and $\beta_a$ are not illustrated in Fig., but the geometrical definition and meaning thereof can refer to and use FIG. 12 for reference), these parameters still need to follow the parameter constraint formula as given above, i.e., needing to meet:

$$\frac{R_a}{r_a} = 1 + \frac{\alpha_a}{\beta_a}.$$

Similarly, it is assumed that a pitch radius of the second stationary gear tooth section 4*b* and the second rotary gear tooth section 5*b* that are mutually engaged is $R_b$ and $r_b$ respectively (see FIG. 13), and when an angle of the jaw protector 2 turned relative to the helmet housing body 1 during the engagement thereof is $\alpha_b$, a central angle turned by the first rotary gear axis 05*a* is $\beta_b$ relatively (the parameters $\alpha_b$, and $\beta_b$ are not illustrated in figure, but the geometrical definition and meaning thereof can refer to FIG. 12), these parameters still need to follow the parameter constraint formula as given above, i.e., needing to meet:

$$\frac{R_b}{r_b} = 1 + \frac{\alpha_b}{\beta_b}.$$

For the engagement of the stationary gear 4 and the rotary gear 5 in the cylindrical gear form having two gear tooth sections and belonging to the plane gear transmission mechanism, the axis locus of the rotary gear 5 is formed by two sections of locus lines, including a first axis locus L1 formed by the first rotary gear axis 05*a* of the first rotary gear tooth section 5*a* and a second axis locus L2 formed by the second rotary gear axis 05*b* of the second rotary gear tooth section 5*b* (see FIG. 9 and FIG. 13). In order to ensure that the position of the jaw protector 2 is not jumped during the course of cross connection of the two different gear tooth sections so that the jaw protector 2 is able to smoothly cross a cross connecting area, the first rotary gear axis 05*a* of the first rotary gear tooth section 5*a* and the second rotary gear axis 05*b* of the second rotary gear tooth section 5*b* are overlapped together (as illustrated in FIG. 9, FIG. 10 and FIG. 13), that is to say, the first rotary gear tooth section 5*a* and the second rotary gear tooth section 5*b* have the same gear axis (05*a* and 05*b*). In addition, in order to ensure that the movement cross section of the jaw protector 2 during the course of cross connection of the two different gear tooth sections has good smoothness, the first axis locus L1 of the first rotary gear tooth section 5*a* and the second axis locus L2 of the second rotary gear tooth section 5*b* have an intersection point Q, and the first axis locus L1 and the second axis locus L2 are tangent in the intersection point Q (as illustrated in FIG. 9 and FIG. 13), in other words, the first axis locus L1 and the second axis locus L2 in the intersection point Q has only one unique common tangent. It is obvious that, for the first rotary gear tooth section 5*a* and the second rotary gear tooth section 5*b* having the same gear axis (05*a* and 05*b*), the first axis locus L1 of the first rotary gear tooth section 5*a* and the second axis locus L2 of the second rotary gear tooth section 5*b* have an intersection point Q naturally, particularly, if the first rotary gear tooth section 5*a* and the second rotary gear tooth section 5*b* also have an equal reference circle radius at the moment, then there are infinitely many intersection points Q, and the rotary gear 5 is degraded into a gear with only one gear tooth section at this time. It is worth pointing out that, the respective gear tooth section portion of the stationary gear 4 and the rotary gear 5 having the two gear tooth sections can adopt a discontinuous design layout, that is to say, the first stationary gear tooth section 4*a* and the second stationary gear tooth section 4*b* can be staggered, that is also to say, the first stationary gear tooth section 4*a* and the second stationary gear tooth section 4*b* are not directly abutted together (see FIG. 4, FIG. 9, FIG. 10 and FIG. 13), relatively, the first rotary gear tooth section 5*a* and the second rotary gear tooth section 5*b* can also be staggered, that is to say the first rotary gear tooth section 5*a* and the second rotary gear tooth section 5*b* are not directly abutted together (see FIG. 4, FIG. 7 to FIG. 10 and FIG. 13). Of course, the respective gear tooth section portion of the stationary gear 4 and the rotary gear 5 having two gear tooth sections can also adopt a continuous design layout, that is to say, the first stationary gear tooth section 4*a* and the second stationary gear tooth section 4*b* can be abutted together (without being illustrated in figure), and the first rotary gear tooth section 5*a* and the second rotary gear tooth section 5*b* can also be abutted together (without being illustrated in figure). In order to be able to keep good engagement between the rotary gear 5 and the corresponding stationary gear 4 better, the mount or/and the helmet housing body 1 can be provided with an arc slot 7 (as illustrated in FIG. 4, FIG. 9, FIG. 10, FIG. 11 and FIG. 13). At this time, the arc slot 7 can constrain an axle head 5*c* of the rotary gear 5 by means of two rail sides 7*a* thereof and hereby involves in the movement of constraining the rotary gear 5, so that the rotary gear 5 and the corresponding stationary gear 4 are kept in engagement contact. A best structural form of the axle head 5*c* is a cylindrical surface (see FIG. 4, FIG. 7 and FIG. 8), that is because the cylindrical surface is likely to preferably adapt to slide fit between the axle head 5*c* and the arc slot 7. A situation that the arc slot 7 in the external cover 3*b* is matched with the axle head 5*c* is given in FIG. 14. When the arc slot 7 is arranged on the mount 3, the arc slot 7 can be either separately opened in the external cover 3*b* merely or opened in both the external cover 3*b* and the bottom cover 3*a* at the same time. It should be noted that, the arc slot 7 can be in either a through through-slot-like structure (as illustrated in FIG. 4) or a non-through sink-slot-like structure (without being illustrated in figure), and the through-slot-like structure and the sink-slot-like structure can be coexisted, for example, the external cover 3*b* can be provided with the arc slot 7 in the through-slot-like structure and the bottom cover 3*a* can also be provided with the arc slot 7 in the sink-slot-like structure in the meanwhile (without being illustrated in figure). The best form is that both the external cover 3*b* and the bottom cover 3*a* of the mount 3 are provided with the arc slot 7 in the through-slot-like structure (as illustrated in FIG. 4), at the same time, both two side axle ends of the same rotary gear 5 are provided with the axle head 5*c* to match, so that the movement stability of the rotary gear 5 can be constrained and kept preferably.

Figure 14:
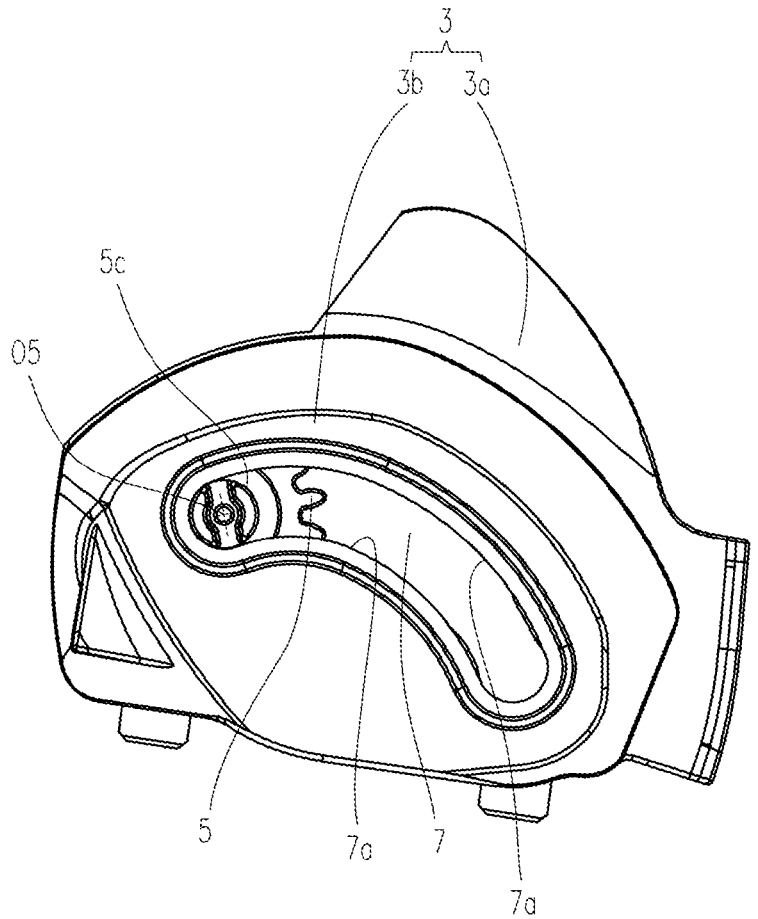
FIG. 14 is a schematic diagram of an arc slot on an outer cover of a mount of a helmet with a transformable jaw protecting structure based on gear constraint according to the present invention being matched with an axle head of a rotary gear.

It should be noted that, the arc slot 7 in the external cover 3*b* is preferably in the through-slot like structure (as illustrated in FIG. 4 and FIG. 14), so that the structure of the prong 2*a* associated with the rotary gear 5 is simpler. At this time, the best layout of the arc slot 7 in the external cover 3*b* is that the jaw protector 2, whether in the full-face helmet position or the half-face helmet position, can effectively shield the arc slot 7 so as not to expose to the greatest extent (i.e., the arc slot 7 is seen less or even is not seen when observing the helmet from the outside), such structure layout can effectively reduce buzzing noises deviated from the exposed clearance when an air current flows through the helmet housing body 1. In addition, it should be noted that, the best structure form of the arc slot 7 is that: the arc slot 7 takes the axis movement locus line of the rotary gear 5 as a center parting line thereof, in other words, the center parting line of the arc slot 7 is the axis locus L of the rotary gear (see FIG. 11). At this time, two rail sides of the arc slot 7 constraining the axle head 5*c* to move to-and-fro become equidistant sides of the axis locus L of the rotary gear and disposed near both sides of the axis locus L of the rotary gear (as illustrated in FIG. 11). Of course, if both the stationary gear 4 and the rotary gear 5 are gears including two gear tooth sections, then both the first axis locus L1 of the first rotary gear tooth section 5*a* and the second axis locus L2 of the second rotary gear tooth section 5*b* are a halving line of the two rail sides 7*a* of the arc slot 7, that is to say, the two rail sides 7*a* are disposed near both sides thereof in an equidistant manner (see FIG. 13). It should be still noted that, the arc slot 7 can be opened in the bottom cover 3*a* separately (without being illustrated in figure), or can be opened in the external cover 3*b* separately (without being illustrated in figure), or can be opened in both the bottom cover 3*a* and the external cover 3*b* at the same time (as illustrated in FIG. 4). When the jaw protector 2 is located in the two limit positions of the full-face helmet structure position or the half-face helmet structure position, in order to be able to effectively reduce or even completely eliminate a clearance between the axle head 5*c* and the arc slot 7 to ensure the good stability and reliability when locking the jaw protector 2, an elastic locking configuration 8 can be arranged either on the mount 3 (as illustrated in FIG. 4) or the helmet housing body 1 (without being illustrated in figure). The layout position of the elastic locking configuration 8 is corresponding to two end heads of the arc slot 7, wherein the two end heads of the arc slot 7 are corresponding to the full-face helmet position and half-face helmet position of the jaw protector 2 respectively. The elastic locking configuration 8 is composed of an elastic strip 8*a* and a preset seam 8*b* (see FIG. 4 and FIG. 13), wherein the elastic strip 8*a* is slightly inserted into the arc slot 7 and a width of the slot is slightly less than a diameter of the axle head 5*c* of the rotary gear 5, and the function of the preset seam 8*b* is to preset a certain elastic deformation back-off space for the elastic strip 8*a*, the axle head 5*c* of the rotary gear 5 has to extrude the elastic strip 8*a* to generate the elastic deformation, then the elastic strip 8 finally enters into the end head of the arc slot 7 via the arc slot 7 here (at this time, being exactly in the full-face helmet position or the half-face helmet position corresponding to the jaw protector 2), once the axle head 5*c* of the rotary gear 5 enters into the end head portion of the arc slot 7, the elastic strip 8*a* is inserted into the arc slot 7 again by means of an elastic recovery character thereof and blocks the axle head 5*c* to be unable to easily back off, so that the rotary gear 5 is limited and is unable to easily shift, and the final result thereof is that the stability of locking the jaw protector 2 in the two limit positions of full-face helmet position and the half-face helmet position is increased. In conclusion, a gear mechanism is adopted to constrain the movement locus and action of the jaw protector 2 in the present invention, which can reliably enable the jaw protector 2 to transform between the full-face helmet structure position and the half-face helmet structure position and can keep the geometrical locus thereof unique and reversible. In the meanwhile, since it is unnecessary to set more through-like slot seam structure, the integrity of the overall structure of the mount 3 and the jaw protector 2 is kept, so as to ensure that these helmet core members have high intensity and rigidity, therefore, the use safety of the helmet can be effectively increased; in addition, the use of the above-mentioned constraint mechanism can also reduce or even completely eliminate the exposed slot seam on the surface of the helmet, thus reducing the buzzing noises deviated by flowing the air current through the surface of the helmet housing body 1, and reducing the possibility of rainwater invasion, and consequently, the wear comfort of the helmet can be dramatically improved; moreover, since the structure integrity of the mount 3 and the jaw protector 2 is increased and the difficulty in assembly thereof is reduced, and the gear engagement also belongs to a precise and reliable constraint structure, the quality reliability of the helmet can be effectively improved.

In the present invention, in order to be able to ensure the normal driving of the driver in complicated environment conditions, such as dust and rainwater weathers, the helmet can be provided with one protective guard 6 (as illustrated in FIG. 1 to FIG. 6), the installation of the protective guard 6 can effectively prevent the dust and rainwater, and in addition, can also avoid head-on wind from blowing eyes, so that the driving safety and comfort can be effectively improved. It should be noted that, the protective guard 6 can transform the position relative to the helmet housing body 1, and can be opened or buckled according to the need. When the protective guard 6 is in the buckling state, the above-mentioned protection role can be played; but when the protective guard 6 is in the opened position, drinking water, communicating by phone and other actions can be taken. In the present invention, the body of the protective guard 6 is a lens made of a transparent material, in addition, the protective guard 6 in the present invention further comprises two legs 6*a*, therefore, the protective guard 6 described in the present invention means that the member is an assembling unit including the lens and the two legs 6*a*, the protective guard 6 is installed on the helmet housing body 1 via the two legs 6*a* thereof (as illustrated in FIG. 4) or installed on the mount 3 (without being illustrated in figure), the protective cover 6 can swing or rotate at a certain angle relative to the helmet housing body 1, the best structure form of the protective guard 6 is that the lens thereof is clamped and fit on the leg 6*a* using a detachable clamping structure, so that the lens can be installed more quickly and the lens can be replaced when necessary. As previously mentioned, the jaw protector 2 of the helmet of the present invention refers to a transformable structured jaw protector 2, that is to say, the position layout thereof can be transformed between the full-face helmet structure position and the half-face helmet structure position according to the need. In order to ensure that the jaw protector 2 can be smoothly turned over from the full-face helmet structure position to the half-face helmet structure position, and can be returned to the full-face helmet structure position from the half-face helmet structure position, the jaw protector 2 of the present invention has to cross over the protective guard 6 in the largest opened position, therefore, an assembly of cut surfaces of the protective guard by a horizontal half joint P of the helmet housing body 1 in a largest opened position is not globally intersected with a locus assembly of cut surfaces of the jaw protector 2 by a horizontal half joint P of the helmet housing body 1 during the overall movement via design planning particularly in the present invention. A locus line T of a labial tubercle M of the jaw protector 2 (the locus line T can be deemed to be distributed on the horizontal half joint P) is provided in FIG. 12. In fact, the labial tubercle M is fallen upon the intersection line S3 (see FIG. 4), and the labial tubercle M is always cut by the horizontal half joint P in the running process of the jaw protector 2. It is noted that the locus line T is an internal envelope line of locus assembly of the cut surfaces of the jaw protector 2 by the horizontal half joint P (i.e., a locus envelope line of the jaw protector 2 closest to the helmet housing body 1), so that the protective guard 6 of the present invention in the largest opened position is not interfered with the jaw protector 2 as long as the cut surfaces of the protective guard 6 by the horizontal half joint P in the largest opened position are all fallen in the locus line T and are not intersected. The present invention exactly implements the locus planning of the jaw protector 2 according to this principle, and thus, the layout of the protective guard 6 in the largest opened position is implemented.

Figure 17:
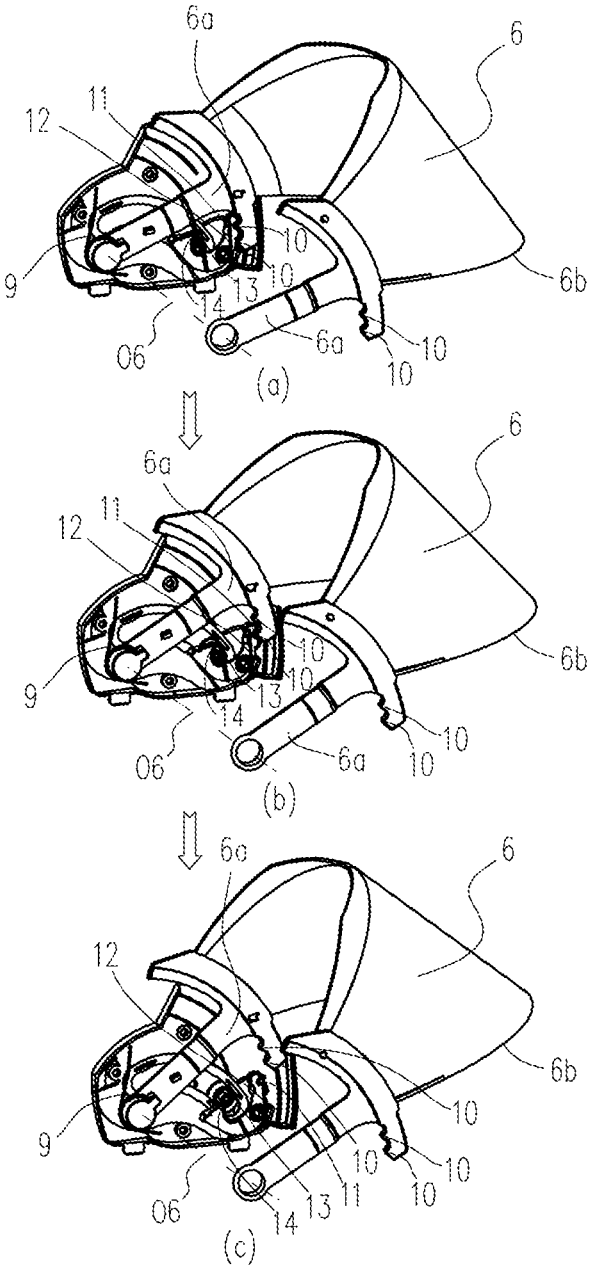
FIG. 17 is a schematic diagram of an unlocking process state of a protective guard of a helmet with a transformable jaw protecting structure based on gear constraint according to the present invention.

In the present invention, the protective guard 6 is supported by the two legs 6*a* thereof and installed on the helmet housing body 1 or installed on the mount 3. In order to be able to conveniently open and buckle the protective guard 6, the protective guard 6 can carry out two-dimensional rotation within a certain amplitude range (i.e., merely rotary-type opened movement, as illustrated in FIG. 4 and FIG. 17), or can carry out two-dimensional rotation and movement combined with two-dimensional movement (without being illustrated in figure), or can further carry out three-dimensional rotation and three-dimensional movement (without being illustrated in figure). From the perspective of simple structure, the situation of arranging the leg 6*a* to carry out the movement that is equivalent to two-dimensional plane movement is better. Particularly, in the present invention the opened movement of the protective guard 6 can be designed as a fixed-axis rotation movement, that is to say, at least one leg 6*a* of the protective guard 6 is provided with a fixed-axis protective guard rotation center 06, and the protective guard 6 can surround the protective guard rotation center 06 to rotate at a certain turn angle (as illustrated in FIG. 4 and FIG. 17). Here, the protective guard rotation center 06 is immobile relative to the helmet housing body 1. The advantages of setting the opened and buckled actions of the protective guard 6 as fixed-axis rotation are as follows: firstly, a supporting structure and layout of the protective guard 6 can be simplified, secondly, the movement arrangement of the protective guard 6 can be simplified and the locus planning of the jaw protector 2 can be simplified favorably. It should be pointed out that, when the opened movement of the protective guard 6 is designed as the fixed-axis rotation, in order to obtain the reliable rotation supporting and avoid from movement interference, both the two legs 6*a* of the protective guard 6 should be provided with the protective guard rotation center 06 respectively (as illustrated in FIG. 4), and it is preferable to enable a connecting line of the two protective guard rotation centers 06 of these legs 6*a* to be mutually perpendicular to the horizontal half joint P of the helmet housing body 1. In addition, in order to be able to quickly open the jaw protector 6, a driving spring bounced up to open the protective guard 6 can be provided (see FIG. 4 and FIG. 17). In this way, even if needing to open the protective guard 6 in emergency conditions, such as a need for calling for help in case of an accident, a need for enabling the eyesight to quickly adapt to darkness when passing through a dark tunnel and the like, the driver only needs to slightly touch or move the protective guard 6 to quickly open the protective guard 6 by virtue of a up-bouncing force of a spring 9. The driving spring 9 can be a torsion spring (as illustrated in FIG. 4 and FIG. 17), or can be a common cylindrical spring (without being illustrated in figure), or can also be other forms of springs, such as a plate spring, a housing spring, a pole spring and the like generating an elastic force by virtue of deformation (without being illustrated in figure), wherein the driving spring 9 in a torsion spring structure is a better form, therefore, a space occupied by the spring in such form is smaller, which is beneficial for the compact design of the helmet. In addition, it should be pointed out that, a force application form of the driving spring 9 to the protective guard 6 can be either a tensile force form or a pressure force or even a thrust form, in addition, can also be a torsion form. For the driving spring 9 in a torsion spring structure, the force application form of generating the torsion to the protective guard 6 is the best form.

Figure 15:
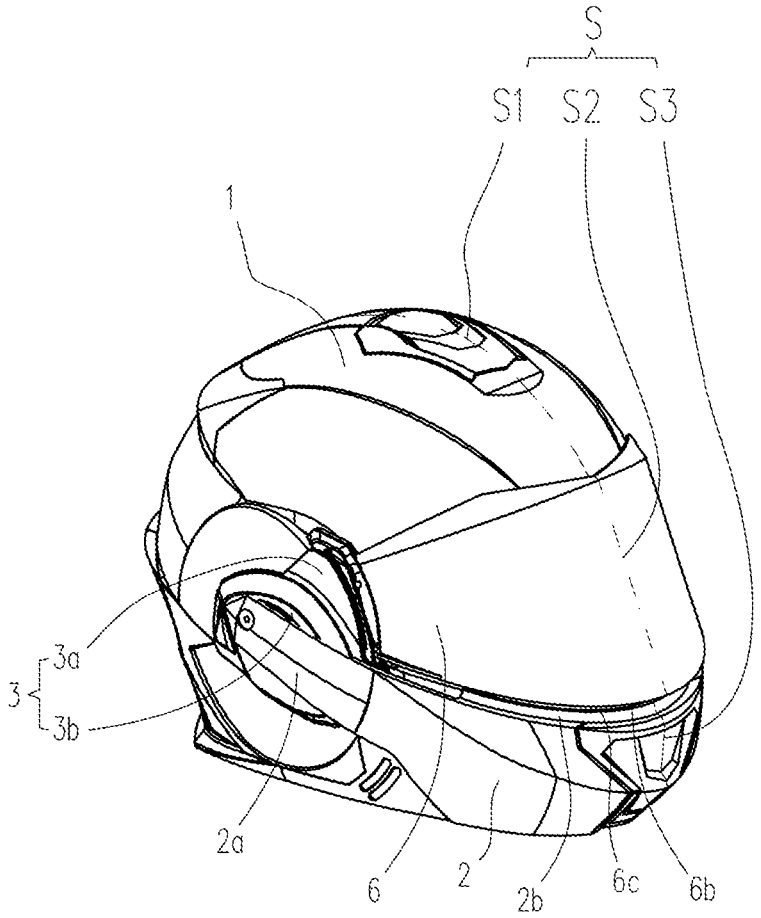
FIG. 15 is an isometric view of an air permeable gap between a protective guard and a jaw protector of a helmet with a transformable jaw protecting structure based on gear constraint according to the present invention.
Figure 16:
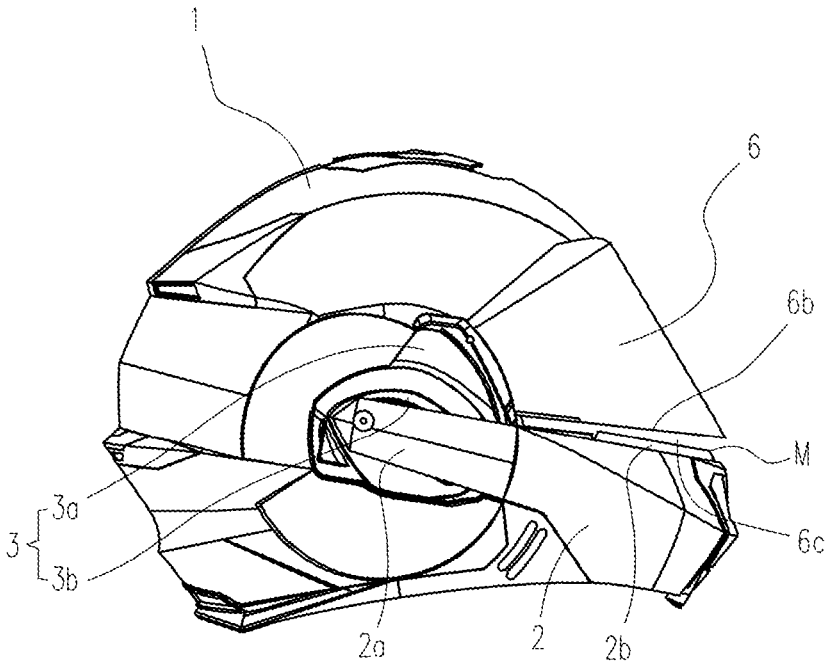
FIG. 16 is a side schematic diagram of the air permeable gap between the protective guard and the jaw protector as illustrated in FIG. 15.

In the present invention, in order to correspond to the buckling state of the protective guard 6, often needing to show and to be able to lock the protective guard 6 in the buckling state position, the helmet can be correspondingly provided with a latch cam 10, a locking cam 11 and a locking spring 12 (see FIG. 4 and FIG. 17), wherein the latch cam 10 and the protective guard 6 are tightly connected with each other (without being illustrated in figure) or the latch cam 10 and the protective guard 6 are made in an integral structure (in FIG. 4 and FIG. 7, the latch cam 10 and the leg 6*a* of the protective guard 6 are made in an integral structure), the locking cam 11 and the locking spring 12 are installed on the helmet housing body 1 or/and the mount 3 (a situation that both the locking cam 11 and the locking cam 12 are installed on the helmet housing body 1 is shown in FIG. 4 and FIG. 17), the locking cam 11 can generate a certain displacement motion or/and rotation swing with respect to the helmet housing body 1, the function of the locking spring 12 is to prompt the locking cam 11 and the latch cam 10 to engage in a normal state and to lock the protective guard 6 in a buckling position thereof when the protective guard 6 is buckled, the locking spring 12 can be a torsion spring (as illustrated in FIG. 4 and FIG. 17), or can be a common cylindrical spring (without being illustrated in figure), or can also be other forms of springs, such as a plate spring, a housing spring, a pole spring and the like generating an elastic force by virtue of deformation (without being illustrated in figure), wherein the locking spring 12 in a torsion spring structure is the better form. It should be noted that, the protective guard 6 in the buckling state or in the buckling position means the protective guard 6 in such position with respect to the helmet housing body 1: the protective guard 6 is located in front of the eyes and nose of the driver and can shield the eyes of the driver, particularly, when the jaw protector 2 is still located in the full-face helmet structure position at the moment, the buckling position of the protective guard 6 still at least contains two states: one state is that a lower edge 6*b* of the protective guard 6 is adhered to a lip side 2*b* of the jaw protector 2, the protective guard 6 has better rain-proof, wind-proof and dust-proof effects at this time; and the other state is that a certain air permeable gap 6*c* is arranged between the lower edge 6*b* of the protective guard 6 and the lip side 2*b* of the jaw protector 2 (as illustrated in FIG. 15 and FIG. 16). At this time, a little external air can be introduced by the air permeable gap 6*c* to blow away water vapor and water mist generated by breathing on the inner wall of the protective guard and in the helmet housing body 1. Thus it can be seen that the protective guard 6 in the buckling position as described in the present invention is one type of state; the function of the locking cam 11 is to keep or lock the protective guard 6 in some buckling position via the engagement with the latch cam 10, of course, the engagement between the locking cam 11 and the latch cam 10 can also be unlocked by other mechanisms or other members when necessary to open the protective guard 6.

In the present invention, in order to solve the problem of transformation between a locking state and an unlocking state of the protective guard 6, whether the locking cam 11 and the latch cam 10 are engaged to lock or not engaged to unlock can be determined according to the need, an unlocking component 13 and an unlocking cam 14 can be provided, wherein the unlocking cam 14 is an independent piece and is fastened on the locking cam 11 (without being illustrated in figure), or the unlocking cam 14 and the locking cam 11 are made in an integral structure (as illustrated in FIG. 4 and FIG. 17), which means that the unlocking cam 14 and the locking cam 11 are moved together or linked. In order to correspond to the position state of the jaw protector 2, the above locking action or unlocking action is taken. The unlocking component 13 is driven by the prong 2*a* of the jaw protector 2 or driven by the rotary gear 5 to operate. It is noted that the prong 2*a* of the jaw protector 2 and the rotary gear 5 are linked together, which means that the unlocking component 13 can drive the unlocking cam 14 according to the movement process of the jaw protector 2, and then drive the locking cam 11, so that the locking cam 11 and the latch cam 10 in the locking state can be disengaged and unlocked when necessary. It should be noted that, when the unlocking component 13 is driven by the prong 2*a* of the jaw protector 2 or the rotary gear 5, a substantive unlocking action of unlocking the locking cam 11 and the latch cam 10 in the engagement state can be generated (see FIG. 17), but there can be another situation, that is the protective guard 6 has been in the up-bouncing and opening state at the moment or that means the latch cam 10 and the locking cam 11, in fact, have been in a state of disengagement, but the unlocking component 13 can still drive the unlocking cam 14 to unlock, it is obvious that the unlocking action, at this time, belongs to an empty action or a redundancy action, and does not obstruct and affect the normal operation of the jaw protector 2. It should be particularly pointed out that, in the present invention, the unlocking action of the protective guard 6 in the buckling position and in the locking state can still be directly driven by the protective guard 2 to complete, at this time, the protective guard 2 has to be in the full-face helmet structure position and the protective guard 6 is in the buckling position (the state as illustrated in FIG. 4 and FIG. 17 is exactly corresponding to such situation), the jaw protector 2 is turned by the hand of the driver and moves from the full-face helmet position to the half-face helmet position, the jaw protector 2 contacts with the lower edge 6*b* of the protective guard 6 to forcibly drive the protective guard 6 to open, and the locking cam 11 is pressed by the latch cam 10 linked with the protective guard 6 when the protective guard 6 moves, and then the locking spring 12 is pressed by the locking cam 11 and is prompted to retract and withdraw, and finally the locking cam 11 and the latch 10 are forced to disengage to completely unlock. In this process, the unlocked protective guard 6 can be rapidly opened by virtue of an up-bouncing force of the driving spring 9, and the protective guard 6 is bounced up and opened to the largest opened position before the jaw protector 2 reaches the top end of the helmet housing body 1. In FIG. 5, the process shown by FIG. 5(*a*) FIG. 5(*b*) is such situation.

In the present invention, in order to prevent and avoid from being likely to be collided with and interfered with the protective guard 6 when the jaw protector 2 is returned to the full-face helmet structure position from the half-face helmet structure position, it is particularly arranged that the unlocking component 13 at least completes a whole unlocking action for the locking cam 11 and the latch cam 10 when the jaw protector 2 is within the first one third of full stroke of returning to the full-face helmet structure position from the half-face helmet structure position, with the purpose of avoiding appearing this condition: the jaw protector 2 is returned to the full-face helmet structure position from the half-face helmet structure position, but in this process, the protective guard 6 still always stays and is held on the buckling position, at this time, the protective guard 6 is very likely to be beaten during the course of falling the jaw protector 2 down, so that the protective guard 6 and the jaw protector 2 are damaged, and particularly, the lens of the protective guard 6 is damaged. Therefore, in the present invention it is particularly arranged that the unlocking component 13 at least completes a whole unlocking action for the locking cam 11 and the latch cam 10 when the jaw protector 2 is within the first one third of full stroke of returning to the full-face helmet structure position from the half-face helmet structure position, that is to say, an enough response time is left for the protective guard 6, so that the protective guard 6 is completely bounced up and achieves to the largest opened position when the jaw protector 2 reaches the top end of the helmet housing body 1. It can be known from the foregoing design, the cut surfaces of the protective guard 6 by the horizontal half joint P in the largest opened position are all fallen in the locus line T and are not intersected, it can be seen that this can ensure the jaw protector 2 and the protective guard 6 are not collided and interfered with each other when the jaw protector 2 is returned to the full-face helmet structure position from the half-face helmet structure position. In FIG. 6, the process shown by FIG. 6(*a*) FIG. 6(*b*) is such situation.

In the present invention, the unlocking component 13 can be in various structures, for instance, the unlocking component 13 can be set in an oscillating bar structure (without being illustrated in figure): wherein an oscillating bar is in a fixed-axis sway, a trigger pin and a sliding chute are arranged in the oscillating bar, the trigger pin can trigger the unlocking cam 14, the sliding chute is in movement coordination with a boss pin of the rotary gear (without being illustrated in figure), when the rotary gear 5 moves, the sliding chute is toggled by the boss pin to drive the oscillating bar to sway, that is to say, the unlocking component takes an unlocking action; particularly, the unlocking component 13 can be set as a cylindrical pin and the axle line of the cylindrical pin and that of the rotary gear 5 are coaxially arranged (as illustrated in FIG. 4, FIG. 7, FIG. 8 and FIG. 17), the cylindrical pin and the rotary gear 5 are tightly connected or made in an integral structure, at this time, the cylindrical pin, in fact, can become an extension component of the axle head 5*c* of the rotary gear 5, a method of setting the unlocking component 13 as the cylindrical pin can maximally simplify the structure of the unlocking component 13 and has the simplest driving step, therefore, the unlocking component 13 is in the better structure form.

In the present invention, in order to meet different requirements of the driver, the protective guard 6 can have different states of buckling position: 1) for instance, when needing to avoid dust interference and rainwater interference, the protective guard 6 and the jaw protector 2 need to have good adhesion performance, just as the state shown in FIG. 1, FIG. 2 and FIG. 5(*a*), at this time, it is preferable to enable the lower edge 6*b* of the protective guard 6 and the lip side 2*b* of the jaw protector 2 in an adhesion position state; 2) also for instance, when needing to blow away the water mist generated by breathing of the driver on the protective guard 6 and in the helmet housing body 1, or when the driver needs some outside cooling wind to reduce the heat in the helmet, the protective guard 6 needs to be slightly opened at this time to disengage the lower edge 6*b* and the lip side 2*b* of the jaw protector 2 and form a certain air permeable gap 6*c* (such state is exactly illustrated in FIG. 15 and FIG. 16). It should be noted that, the lower edge 6*b* of the protective guard 6 and the lip side 2*b* of the jaw protector 2 in the adhesion position state means that the lower edge 6*b* and the lip side 2*b* are certainly overlapped and engaged, which comprises the lower edge 6*b* having part of length section embraces the lip side 2*b* (at this time, the lower edge 6*b* is located outside while the lip side 2*b* is located inside, the state reflected in FIG. 1 and FIG. 2 is such situation), and further comprises the lip side 2*b* having part of length section embraces the lower edge 6*b* (at this time, the lower edge 6*b* is located inside while the slip side 2*b* is located outside, without being illustrated in figure). Corresponding to the protective guard 6 in the above two buckling positions, the present invention can enable the locking cam 11 and the latch cam 10 in two engagement locking states: the first locking state is that the protective guard 6 is locked in the buckling position and the lower edge 6*b* of the protective guard 6 is adhered to the lip side 2*b* of the jaw protector 2 (as illustrated in FIG. 1 and FIG. 2), and the second locking state is that the jaw protector 6 is locked in the buckling position but the air permeable gap 6*c* is arranged between the lower edge 6*b* of the protective guard 6 and the lip side 2*b* of the jaw protector 2 (as illustrated in FIG. 15 and FIG. 16). In order to achieve the buckling state of the above two protective guards 6, the locking cam 11 and the latch cam 10 can adopt the following various engagement assemblies: 1) the latch cam 10 comprises only one convex tooth configuration, in the meanwhile, the locking cam 11 is provided with two concave tooth configurations corresponding to the convex tooth configuration of the latch cam 10 (without being illustrated in figure), the convex tooth configuration of the latch cam 10 and the concave tooth configurations of the locking cam 11 can be engaged and have two engagement combinations, wherein one combination is corresponding to the first locking state and the other combination is corresponding to the second locking state; 2) the latch cam 10 comprises two convex tooth configurations, and in the meanwhile, the locking cam 11 is provided with two concave tooth configurations corresponding to the convex tooth configuration of the latch cam 10 (as illustrated in FIG. 4 and FIG. 17), when the two convex tooth configurations of the latch cam 10 are engaged with the two concave tooth configurations of the locking cam 11 respectively at the same time, the first locking state appears correspondingly, and when only one convex tooth configuration of the latch cam 10 is engaged with the concave tooth configuration of the locking cam 11, the second locking state appears correspondingly; 3) the latch cam 10 comprises only one concave tooth configuration, in the meanwhile, the locking cam 11 is provided with two convex tooth configurations corresponding to the concave tooth configuration of the latch cam 10 (without being illustrated in figure), the concave tooth configuration of the latch cam 10 and the convex tooth configurations of the locking cam 11 can be engaged and have two engagement combinations, wherein one combination is corresponding to the first locking state and the other combination is corresponding to the second locking state; 4) the latch cam 10 comprises two concave tooth configurations, and in the meanwhile, the locking cam 11 is provided with two convex tooth configurations corresponding to the concave tooth configuration of the latch cam 10 (without being illustrated in figure), when the two concave tooth configurations of the latch cam 10 are engaged with the two convex tooth configurations of the locking cam 11 respectively at the same time, the first locking state appears correspondingly, and when only one concave tooth configuration of the latch cam 10 is engaged with the convex tooth configuration of the locking cam 11, the second locking state appears correspondingly. A process of fully unlocking the locking cam 11 and the latch cam 10 from the first locking state to the second locking state is given in FIG. 17: FIG. 17(*a*) corresponds to the first locking state; FIG. 17(*b*) corresponds to the second locking state; FIG. 17(*c*) corresponds to the fully unlocking state. It should be noted that, the structure and engagement assembly adopted by the locking cam 11 and the latch cam 10 in FIG. 17 belong to the second engagement assembly in the above listed various assemblies.

In the present invention, in order to slow down an impact of the protective guard 6 on the helmet housing body 1 when the protective guard 6 is in the up-bouncing process, and particularly, is bounced up to the largest opened position, the mount 3 or/and the helmet housing body 1 can be provided with a delay component for slowing down the impact of a up-bouncing terminal of the protective guard 6, the delay component can be a spring (without being illustrated in figure), can also be a specially-made air bag (without being illustrated in figure), and can further be a damping bar (without being illustrated in figure), wherein the delay component in the damping bar configuration has a simplest structure, which can be a gradually lifted dam-like configuration, so that the legs 6*a* of the protective guard 6 in the up-bouncing process are gradually adhered to the delay component and gradually increases a contact resistance, so as to achieve a role for damping buffer.

In the present invention, in order to help the jaw protector 2 smoothly climb over the protective guard 6, and particularly, to enable the jaw protector 2 to be able to cross over the lower edge 6*b* of the protective guard 6 when the protective guard 6 is in the largest opened position, the mount 3 or/and the helmet housing body 1 can be provided with an expansion configuration, the expansion configuration can be a boss or a raised line with a wedge-shaped configuration raised relative to the surface of the mount 3 or the helmet housing body 1, which can force the prong 2*a* to externally expand and deform to help the lip side 2*b* of the jaw protector 2*a* to smoothly climb over the lower edge 6*b* of the protective guard 6 under the opened state (without being illustrated in figure). When the jaw protector 2 starts climbing over the protective guard 6, the jaw protector 2 contacts with the expansion configuration, at this time, the prong 2*a* appears the externally-expanded effect under the constraint of the expansion configuration, therefore, the jaw protector 2 is not interfered with the side edge of the widest part of the protective guard 6, so as to achieve the purpose of smoothly helping the jaw protector 2 climb over the protective guard 6; it should be noted that the widest part of the protective guard 6 is relative to the horizontal half joint P of the helmet housing body 1, the width of the protective guard 6 presented when a distance from the two prong 2*a* of the jaw protector 2 to the horizontal half joint P is the longest at this time.

Compared with the prior art, the present invention has an outstanding advantage that a jaw protector 2 can be reliably transformed between a full-face helmet position and a half-face helmet position in a gear constraint structure and mode, and the uniqueness and reversibility of a kinematical and geometrical locus of the jaw protector can be kept. On the one hand, the integrity of a whole structure of the mount 3 and the jaw protector 2 can be kept, thus ensuring that these core elements have higher intensity and rigidity, and effectively enhancing the use safety of the helmet; on the other hand, an exposed slit in a surface of the helmet housing body 1 may be dramatically reduced or even completely eliminated, so that buzzing noises derived by flowing an air current through a helmet housing surface and rainwater invasion may be significantly reduced, and a wearing comfort of the helmet is effectively improved; and besides, the structural integrity of the mount 3 and the jaw protector 2 is increased and the difficulty in assembling the mount and the jaw protector is reduced, while a gear engagement belongs to a reliable constraint structure, so that the quality reliability of the helmet can be effectively improved.

The embodiments as set forth above are the preferred embodiments of the present invention merely, but not intended to limit the protection scope of the present invention. Therefore, various equivalent changes made according to construction, shape and principle of the present invention shall fall within the protection scope of the present invention.

What is claimed is:

1. A helmet with a transformable jaw protecting structure based on gear constraint, comprising:

a helmet housing body having two sides each with a side face, a jaw protector and two mounts;

wherein the jaw protector is provided with two prongs disposed at both sides of the helmet housing body respectively, the two mounts are arranged at both side faces of the helmet housing body respectively, and the mounts are fastened and installed on the helmet housing body or the mounts and the helmet housing body are made in an integral structure;

wherein two stationary gears fixed relative to the helmet housing body are provided, the two stationary gears are disposed at both sides of the helmet housing body respectively; two rotary gears moving along with the jaw protector are provided, the two rotary gears are also disposed at both sides of the helmet housing body respectively, and the mount, the prong, the stationary gear and the rotary gear at the same side of the helmet housing body constitute an associated group; in the same associated group, the rotary gear and the prong are tightly connected with each other or made in an integral structure, the jaw protector drives the rotary gear to move via the prong, when the rotary gear and the stationary gear are in an engaging movement the stationary gear prompts a position and a phase position of the rotary gear to transform, by this time the position and posture of the jaw protector is also transformed under the constraint of the rotary gear so as to adapt to a transformation between a full-face helmet structure and a half-face helmet structure;

wherein both the stationary gear and the rotary gear are in a form of a cylindrical gear and an engaging mechanism constituted by the stationary gear and the rotary gear belongs to a plane gear transmission mechanism, wherein the stationary gear is an internal gear and the rotary gear is an external gear;

wherein the stationary gear is mutually engaged with the rotary gear, a pitch radius of the stationary gear is R, a pitch radius of the rotary gear is r, a relatively rotated central angle of axis of the rotary gear is β while a rotated angle of the jaw protector relative to the helmet housing body is α during engagement, and these parameters meet a constraint formula:

$$\frac{R}{r} = 1 + \frac{\alpha}{\beta}.$$

2. The helmet with the transformable jaw protecting structure based on gear constraint according to claim 1, wherein the stationary gear and the mount arranged in the same associated group are tightly connected with each other or made in an integral structure.

3. The helmet with the transformable jaw protecting structure based on gear constraint according to claim 2, wherein the stationary gear comprises a first stationary gear tooth section and a second stationary gear tooth section, the rotary gear comprises a first rotary gear tooth section and a second rotary gear tooth section, the first rotary gear tooth section in the same associated group is engaged with the first stationary gear tooth section only, and the second rotary gear tooth section is engaged with the second stationary gear tooth section only.

4. The helmet with the transformable jaw protecting structure based on gear constraint according to claim 3, wherein in the same associated group, an axis of the first rotary gear tooth section is overlapped with an axis of the second rotary gear tooth section.

5. The helmet with the transformable jaw protecting structure based on gear constraint according to claim 4, wherein in the same associated group, a first axis locus of the first rotary gear tooth section is tangent with a second axis locus of the second rotary gear tooth section in a point of intersection thereof.

6. The helmet with the transformable jaw protecting structure based on gear constraint according to claim 5, wherein the mount or/and the helmet housing body is/are provided with an arc slot, and the arc slot constrains the movement of the rotary gear and keeps the constrained rotary gear engaged with the corresponding stationary gear.

7. The helmet with the transformable jaw protecting structure based on gear constraint according to claim 6, wherein the mount or/and the helmet housing body is/are provided with an elastic locking construction, a layout position of the elastic locking construction is relevant to both end heads of the arc slot, wherein the two end heads of the arc slot are corresponding to a full-face position and a half-face position of the jaw protector respectively.

8. The helmet with the transformable jaw protecting structure based on gear constraint according to claim 7, wherein the helmet is provided with a protective guard, and an assembly of cut surfaces of the protective guard by a horizontal half joint of the helmet housing body in a largest opened position is not intersected with a locus assembly of cut surfaces of the jaw protector by a horizontal half joint of the helmet housing body during movement.

9. The helmet with the transformable jaw protecting structure based on gear constraint according to claim 8, wherein an opened movement of the protective guard refers to a fixed-axis rotation, and a driving spring for bouncing up to open the protective guard is provided.

10. The helmet with the transformable jaw protecting structure based on gear constraint according to claim 9, wherein a latch cam, a locking cam and a locking spring are provided, the latch cam and the protective guard are tightly connected or made in an integral structure, the locking cam and the locking spring are installed on the helmet housing body or/and the mount, and the locking spring in a normal state prompts the locking cam and the latch cam to engage and can lock the protective guard in a buckling position thereof when the protective guard is buckled.

11. The helmet with the transformable jaw protecting structure based on gear constraint according to claim 10, wherein an unlocking component and an unlocking cam are provided, the unlocking cam is fastened on or made in an integral structure with the locking cam, the unlocking component is driven by the prong of the jaw protector or driven by the rotary gear, and the unlocking component can drive the locking cam to carry out an unlocking action of disengaging the locking cam and the latch cam in a locking state by driving the unlocking cam according to the need.

12. The helmet with the transformable jaw protecting structure based on gear constraint according to claim 11, wherein in a first one third of stroke of returning the jaw protector to the full-face helmet position from the half-face helmet position, the unlocking component at least completes one complete unlocking action for the locking cam and the latch cam.

13. The helmet with the transformable jaw protecting structure based on gear constraint according to claim 12, wherein the unlocking component is a cylindrical pin and an axis of the cylindrical pin and that of the rotary gear are arranged coaxially, and the cylindrical pin and the rotary gear are tightly connected or made in an integral structure.

14. The helmet with the transformable jaw protecting structure based on gear constraint according to claim 13, wherein corresponding to the protective guard in the buckling position, the locking cam and the latch cam possess two engagement locking states, the first locking state is that the protective guard is locked in the buckling position and a lower edge of the protective guard is adhered to a lip side of the jaw protector, and the second locking state is that the jaw protector is locked in the buckling position and an air permeable gap is arranged between a lower edge of the protective guard and the lip side of the jaw protector.

15. The helmet with the transformable jaw protecting structure based on gear constraint according to claim 14, wherein the mount or/and the helmet housing body is/are provided with a delay component for slowing down an impact of an up-bouncing terminal of the protective guard.

16. The helmet with the transformable jaw protecting structure based on gear constraint according to claim 15, wherein the mount or/and the helmet housing body is/are provided with an expansion construction forcing the prong to externally expand and elastically deform to help the lip side of the jaw protector smoothly climb over the lower edge of the protective guard in an opened state.

17. The helmet with the transformable jaw protecting structure based on gear constraint according to claim 1, wherein the helmet is provided with a protective guard, and an assembly of cut surfaces of the protective guard by a horizontal half joint of the helmet housing body in a largest opened position is not intersected with a locus assembly of cut surfaces of the jaw protector by a horizontal half joint of the helmet housing body during movement.

18. The helmet with the transformable jaw protecting structure based on gear constraint according to claim 17, wherein an opened movement of the protective guard refers to a fixed-axis rotation, and a driving spring for bouncing up to open the protective guard is provided.

19. The helmet with the transformable jaw protecting structure based on gear constraint according to claim 18, wherein a latch cam, a locking cam and a locking spring are provided, the latch cam and the protective guard are tightly connected or made in an integral structure, the locking cam and the locking spring are installed on the helmet housing body or/and the mount, and the locking spring in a normal state prompts the locking cam and the latch cam to engage and can lock the protective guard in a buckling position thereof when the protective guard is buckled.

20. The helmet with the transformable jaw protecting structure based on gear constraint according to claim 19, wherein an unlocking component and an unlocking cam are provided, the unlocking cam is fastened on or made in an integral structure with the locking cam, the unlocking component is driven by the prong of the jaw protector or driven by the rotary gear, and the unlocking component can drive the locking cam to carry out an unlocking action of disengaging the locking cam and the latch cam in a locking state by driving the unlocking cam according to the need.

* * * * *